US008444580B2

(12) United States Patent
Ochi et al.

(10) Patent No.: US 8,444,580 B2
(45) Date of Patent: May 21, 2013

(54) PASSIVE EXERCISE ASSISTING DEVICE

(75) Inventors: Kazuhiro Ochi, Osaka (JP); Youichi Shinomiya, Ibaraki (JP); Takahisa Ozawa, Katano (JP); Takao Goto, Hirakata (JP); Atsuhiro Saitou, Hirakata (JP); Haruo Sugai, Hikone (JP)

(73) Assignee: Panasonic Corporation, Osaka (JP)

( * ) Notice: Subject to any disclaimer, the term of this patent is extended or adjusted under 35 U.S.C. 154(b) by 1074 days.

(21) Appl. No.: 12/442,699

(22) PCT Filed: Sep. 25, 2007

(86) PCT No.: PCT/JP2007/068558

§ 371 (c)(1),
(2), (4) Date: Mar. 24, 2009

(87) PCT Pub. No.: WO2008/041554

PCT Pub. Date: Apr. 10, 2008

(65) Prior Publication Data

US 2010/0010397 A1 Jan. 14, 2010

(30) Foreign Application Priority Data

Sep. 25, 2006 (JP) ..... 2006-259601
Dec. 25, 2006 (JP) ..... 2006-348563
Dec. 25, 2006 (JP) ..... 2006-348637

(51) Int. Cl.
*A61H 1/00* (2006.01)

(52) U.S. Cl.
USPC ..... 601/27; 482/70

(58) Field of Classification Search . 601/27–28; 482/52, 482/70–71, 79–80, 146, 148
See application file for complete search history.

(56) References Cited

U.S. PATENT DOCUMENTS 219,439 A 9/1879 Blend
2,093,830 A 9/1937 Flatley (Continued)

FOREIGN PATENT DOCUMENTS

EP 0 285 438 A2 10/1988
EP 1 350 500 A1 10/2003

(Continued)

OTHER PUBLICATIONS

Supplementary European Search Report for the Application No. EP 07 86 0079 dated Feb. 25, 2010.

(Continued)

*Primary Examiner* — Michael A. Brown
(74) *Attorney, Agent, or Firm* — McDermott Will & Emery LLP

(57) ABSTRACT

A housing is adapted to be placed on a floor and is provided on its top face with a left foot support 2*a* and a right foot supports 2*b* respectively bearing left and right feet of a user. A drive unit 3 is provided to displace the left and right foot supports 2*a* and 2*b* in a mutually linked manner. The drive unit 3 is configured to reciprocate the left and right foot supports 2*a* and 2*b* in a forward/rearward direction respectively along individual travel paths La, Lb, while varying a lateral distance between said left and right foot supports with regard to representative points of the left and right foot supports. The lateral distance between forward ends of the travel paths is made greater than the lateral distance between rearward ends of the travel paths.

26 Claims, 33 Drawing Sheets

U.S. PATENT DOCUMENTS

| | | | | | |
|---|---|---|---|---|---|
| 2,206,902 | A | * | 7/1940 | Kost | 601/27 |
| 2,246,689 | A | | 6/1941 | Kost | |
| 2,969,060 | A | | 1/1961 | Swanda et al. | |
| 3,316,898 | A | | 5/1967 | Brown | |
| 3,374,782 | A | | 3/1968 | Izzo | |
| 3,526,220 | A | | 9/1970 | Small et al. | |
| 3,625,203 | A | | 12/1971 | Wadelton | |
| 3,774,597 | A | | 11/1973 | Root | |
| 3,789,836 | A | | 2/1974 | Girten | |
| 3,917,261 | A | | 11/1975 | Small et al. | |
| 4,185,622 | A | | 1/1980 | Swenson | |
| 4,862,875 | A | | 9/1989 | Heaton | |
| 5,049,079 | A | | 9/1991 | Furtado et al. | |
| 5,148,800 | A | * | 9/1992 | Pecheux | 601/29 |
| 5,176,598 | A | | 1/1993 | Gardner | |
| 5,267,924 | A | | 12/1993 | Miller et al. | |
| 5,304,106 | A | | 4/1994 | Gresko | |
| 5,328,427 | A | | 7/1994 | Sleamaker | |
| 5,902,214 | A | | 5/1999 | Makikawa et al. | |
| 6,042,521 | A | * | 3/2000 | De Giorgis | 482/79 |
| 6,102,832 | A | | 8/2000 | Tani | |
| 6,190,289 | B1 | | 2/2001 | Pyles et al. | |
| 6,500,096 | B1 | | 12/2002 | Farney | |
| 6,740,011 | B1 | * | 5/2004 | Tsai et al. | 482/80 |
| 6,908,416 | B2 | | 6/2005 | Mercado et al. | |
| 7,179,236 | B2 | | 2/2007 | Galvez Campos | |
| 7,402,126 | B2 | * | 7/2008 | Chang | 482/52 |
| 7,413,553 | B2 | | 8/2008 | Chen | |
| 7,510,510 | B2 | | 3/2009 | Chen et al. | |
| 7,513,854 | B1 | | 4/2009 | Stearns et al. | |
| 7,556,592 | B2 | | 7/2009 | Nizam | |
| 2003/0036462 | A1 | | 2/2003 | Ravikumar et al. | |
| 2004/0053753 | A1 | | 3/2004 | Galvez Campos | |
| 2006/0293154 | A1 | | 12/2006 | Graber | |
| 2007/0179411 | A1 | | 8/2007 | Galvez Campos | |

FOREIGN PATENT DOCUMENTS

| | | | |
|---|---|---|---|
| FR | 1354169 | | 3/1964 |
| FR | 2 666 746 | A1 | 3/1992 |
| FR | 2 691 127 | A1 | 11/1993 |
| JP | 3045397 | U | 1/1998 |
| JP | 10-055131 | A | 2/1998 |
| JP | 2000-229108 | A | 8/2000 |
| JP | 2001-087415 | A | 4/2001 |
| JP | 2002-28260 | A | 1/2002 |
| JP | 2002-306630 | A | 10/2002 |
| JP | 2002-325860 | A | 11/2002 |
| JP | 2003-126191 | A | 5/2003 |
| JP | 2003-190235 | A | 7/2003 |
| JP | 2003-290386 | A | 10/2003 |
| JP | 2004-181163 | A | 7/2004 |
| JP | 2005-34481 | A | 2/2005 |
| JP | 2006-101991 | A | 4/2006 |
| JP | 2006-325990 | A | 12/2006 |
| JP | 2007-167625 | A | 7/2007 |
| JP | 2007-236881 | A | 9/2007 |
| JP | 2007-283004 | A | 11/2007 |
| JP | 2007-325903 | A | 12/2007 |
| TW | M263128 | U | 5/2005 |

OTHER PUBLICATIONS

Non-Final Office Action for the U.S. Appl. No. 12/521,031 from the United States Patent and Trademark Office mailed Aug. 19, 2010.

Non-Final Office Action for the U.S. Appl. No. 12/521,118 from the United States Patent and Trademark Office mailed Aug. 30, 2010.

Final Office Action for the U.S. Appl. No. 12/521,118 from the United States Patent and Trademark Office mailed Jun. 30, 2011.

Non-Final Office Action for the U.S. Appl. No. 12/521,118 from the United States Patent and Trademark Office mailed Dec. 21, 2011.

European Search Report for the Application No. EP 11 18 9770 dated Jan. 6, 2012.

Notification of Reasons for Refusal for Application No. 2006-348563 from Japan Patent Office mailed Aug. 16, 2011.

Taiwanese Office Action for the Application No. 096149986 from Taiwan Patent Office dated Oct. 13, 2010.

Notification of the First Office Action for Application No. 200780048148.0 from State Intellectual Property Office of People's Republic of China dated Nov. 9, 2010.

Notification of the First Office Action for Application No. 200780048098.6 from State Intellectual Property Office of People's Republic of China dated Nov. 11, 2010.

Taiwanese Office Action for the Application No. 096135574 from Taiwan Patent Office dated Dec. 9, 2010.

International Search Report for the Application No. PCT/JP2007/068558 mailed Jan. 15, 2008.

Supplementary European Search Report for the Application No. EP 07 80 7830 dated Feb. 18, 2010.

Notification of Reasons for Refusal for Application No. 2007-248128 from Japan Patent Office mailed Aug. 28, 2012.

Korean Office Action for Application No. 10-2009-7014986 dated Sep. 28, 2012.

* cited by examiner (a)

(b)

(a)

(b)

(a)

(b)

(c)

(a)

(b)

(c)

PASSIVE EXERCISE ASSISTING DEVICE

TECHNICAL FIELD

The present invention relates to a passive exercise assisting device which assists a user to stretch ones leg muscles with an aid of external forces mainly in a standing posture.

BACKGROUND ART

In the past, there have been proposed various types of passive exercise assisting devices which assist a user to stretch ones muscles without effort but with an aid of external forces being applied to the user in order to give an exercise effect. The devices are known to be classified into two types, one being configured to apply a force of bending joints of the user for stretching the muscles associated with the joints, and the other configured to apply a stimulus to a user's body to cause a nervous reflex by which associated muscles are forced to stretch.

Further, the devices are designed to require the user to take different postures depending upon the muscles to be stretched. One example of the devices is to simulate a walking by the user at a standing posture mainly for the purpose of preventing osteoarthritis or walk-training, as proposed in JP 2003-290386 A and JP10-55131 A.

JP 2003-290386 A discloses a trailing device which includes a pair of steps bearing thereon left and right feet of the user, and is configured to interlock the reciprocating movements of the left and right steps for providing a skating simulation exercise to the user. The device is designed to adjust a phase difference of 0 to 360 degrees between the left and right steps with regard to the forward/rearward movements as well as to the lateral movements, and is initially set to have the phase difference of 180 degrees and to vary the phase difference in a direction of increasing a period in which the left and right steps moves forward/rearward together. The steps are driven by a driving mechanism to move so that the user can enjoy the passive exercise simply by placing one's feet on the steps and without making an effort or active movement.

Further, the device of JP 2003-290386 A is arranged to shift the user's weight along forward/rearward direction and also along lateral direction such that the user makes the use of one's nervous reflex to keep a balance with an effect of stretching the muscles. The steps are caused to move substantially in parallel with each other so that the weight of the user shifts simultaneously in the forward/rearward direction and the lateral direction.

The device of JP 10-55131 A is designed for walking training or virtual-reality exercise, and includes a pair of left and right foot plates driven by a horizontal driving unit, and means for rotating the foot plates in left-and-right directions in order to vary their position with respect to the forward/rearward direction as well as to vary their orientation, and also for varying the height and the inclination of the foot plates.

DISCLOSURE OF THE INVENTION

Problem to be Solved by the Invention

As described in the above, the device of JP 2003-290386 A is mainly intended to train muscles including the rectus femoris muscle and hamstrings through the skating movement of shifting the foot position relative to the weight of the user, and is additionally equipped with a gimbal which enables to vary a tilt angle of the step in order to stretch leg muscles such as the gastrocnemuis and soles muscles. In other words, the gimbal has to be provided in order to vary the tilt angle of the step to realize an unstable step condition for promoting the venous return caused by the stretching of the leg muscles. Further, since the skating movement is generally accompanied with a heavy load being applied on the knee, it may be effective to give the exercise for prevention of the knee osteoarthritis, but is not likely available to the user suffering from knee pains.

While, on the other hand, the device of JP 10-55131 A is designed to simulate the walking in order to stretch the leg muscles, and therefore is capable of promoting the venous return. Nevertheless, the walking simulation causes the user to receive on ones knee joint the same load as seen in the walking, and therefore may not be available to the user suffering from the knee pains.

As the stretching of the lower leg muscles is effective to promote the venous return of the leg, an exercise device is desired to effectively stretch the lower leg muscles without causing the knee pains.

In view of the above, the present invention has been achieved to provide a passive exercise assisting device which is capable of reducing a load applied to a user's knees yet with a structure of varying a foot position with time, and urging the stretching of lower leg muscles for promotion of venous return.

Means for Solving the Problem

The passive exercise assisting device in accordance with the present invention includes a left foot support and a right foot support respectively configured to bear a user's left foot and right foot; and a drive unit configured to move the left and right foot supports in a mutually linked manner. The drive unit is configured to reciprocate the left and right foot supports in a forward/rearward direction respectively along individual travel paths, while varying a lateral distance between the left and right foot supports with regard to representative points of the left and right foot supports. The lateral distance between forward ends of the travel paths differs the lateral distance between rearward ends of the travel paths. With this arrangement, the foot positions are caused to shift laterally while moving in the forward/rearward direction such that the lateral distance between the forward ends of the travel paths becomes different from the lateral distance between the forward ends of the travel paths. Accordingly, when the foot moving direction is suitably selected, it is possible to reduce shear forces acting on the knee joints in comparison with a case in which the foot is caused to move straight in the forward/rearward direction. Also, since the foot is caused to move along a direction inclined with respect to a straight direction square to the front of the user, lower leg muscles are urged to be stretched to promote venous return to a greater effect than in the case where the foot is caused to move right in the forward/rearward direction. Whereby, the user can be free from calf swelling, and therefore enjoy promoted peripheral blood flow to be relieved from venous congestion.

Generally, it is known that rectus femoris muscle, medial vastus muscle, lateral vastus muscle, biceps femoris muscle, anterior tibial muscle, gastrocnemuis muscle are excited when the foot moves only in a straight direction square to the front of the user, and that the abductor muscle and adductor muscles are excited when the foot moves only in a lateral direction. Since the device of the present invention gives a composite movement with regard to the forward/rearward direction and the lateral direction, a systematic excitation of all these muscles are made. Thus, the stretching of these muscles enhances sugar uptake in the muscles for improvement of type II diabetes. It is also possible to excite long muscles of a thumb that are not easy to be stretched by the forward/rearward movement or the lateral movement alone. Besides, the lower leg muscles can be mainly contracted to lower the blood pressure of a hypertensive user. Further, the device can offer a light load exercise effective as an exercise therapy to a user suffering from heart disease. Still, since the device can provide a light load exercise analogous to a walking for exciting a large number of associated muscles, it gives a great effect of stimulating cerebral nerves, which assures to expect a high recovery effect when used as a rehabilitation for the user suffering from brain dysfunction or treated with a brain operation.

Preferably, the drive unit is configured to move the left and right foot supports such that the lateral distance between the forward ends of the travel paths is greater than that between the rearward ends of the travel paths. In this instance, the user's feet trace the travel paths of V-shape on the front of the user, thereby reducing the shear forces acting on the knee joints.

Alternatively, the drive unit may be configured to move the left and right foot supports such that the lateral distance between the forward ends of the travel paths is shorter than that between the rearward ends of the travel paths. In this case, the user's feet trace the travel paths of inversed V-shape on the front of the user, thereby stretching the lower leg muscles as well as femoral muscles to a great extent.

In combination with anyone of the above versions, the drive unit may be configured to move the left and right foot supports respectively along the travel paths in an opposite phase relation to each other in order to keep a center of gravity of the user at a constant position in the forward/rearward direction. In this case where the user's center is maintained at the constant position with regard to the forward/rearward direction, no acceleration force acts on the user's bust so that the user is easy to keep balancing, and even by a user with less balancing ability. Further, the opposite movement of the foot positions of the left and right feet is cooperative with the differing lateral distance between the forward ends of the travel paths and the rearward ends thereof to bring about twisting of the user's trunk, thereby exiting the viscera for promotion of visceral blood flow.

Further, in combination with anyone of the above versions, the drive unit may be configured to move the left and right foot supports within a common plane so as to realize the device of present invention with a simple structure.

Further, the drive unit may be configured that the travel paths of the left and right foot supports are made linear for realizing the device of present invention with a simple structure. The drive unit may be configured to swing the each of the left and right foot supports about its lateral axis parallel to a width direction of the foot. With this arrangement, the angle of the ankle joint can be varied to give dorsiflexion for stretching the Achilles tendon. Further, repeating dorsiflexion and plantarflexion can stretch calf muscles to promote venous return. Since the foot position varies between the dorsiflexion and plantarflexion, the angle of the ankle joint varies in association with the shifting movement of the user's center, which brings about varying weight distribution on the bottom of the foot and consequently induce a large contraction of the associated muscles.

Further, the drive unit may be configured to move each of the left and right foot supports about its upright axis perpendicular to a top surface of the corresponding one of the left and right foot supports. With this arrangement, it is possible to reduce the shear force acting on the knee joint upon suitable selection of the angle about the upright axis of each foot support. Further, the angle can be varied in accordance with the reciprocating movement of the left and right foot supports in order to rotate the hip joint for improving flexibility thereof.

Further, the drive unit may be configured to move each of the left and right foot supports about its lengthwise axis parallel to a length of the user's foot. Also in this instance, the device can be easily fitted to a bowlegged or knock-kneed user simply by selecting the angle about the upright axis of the foot support Further, the angle can be varied in accordance with the reciprocating movement of the left and right foot supports in order to strengthen the muscles for curing the bowleg or knock-knee.

Further, the present invention proposes a passive exercise assisting device which is capable of moving the user's feet in the forward/rearward direction to excite the rectus femoris muscles, medial vastus muscles, lateral vastus muscles, bicepts femoris muscles, anterior tibial muscles, and gastrocnemuis muscles, thereby promoting sugar uptake in the muscles for curing type II diabetes. For this purpose, a drive unit is incorporated in the device to reciprocate the left and right foot supports so as to move a representative point of each foot support in a forward/rearward direction, while allowing each of the left and right foot supports to rotate about its lateral axis parallel to a width direction of the user's foot. In this instance, each of the left and right foot supports is made rotatable about its lateral axis to vary the angle of the ankle joint. When the angle is set to give the dorsiflextion movement, the device can stretch the Achilles tendon. Further, repeating dorsiflexion and plantarflexion can stretch calf muscles to promote venous return. Since the foot position varies between the dorsiflexion and plantarflexion, the angle of the ankle joint varies in association with the shifting movement of the user's center, which brings about varying weight distribution on the bottom of the foot and consequently induce a large contraction of the associated muscles.

In addition, the drive unit may be configured to reciprocate the left and right foot supports so as to move a representative point of each foot support in a forward/rearward direction, while allowing each of the left and right foot supports to rotate about its upright axis perpendicular to a top surface of the corresponding one of the left and right foot supports. In this instance, it is possible to reduce the shear force acting on the knee joint upon suitable selection of the angle about the upright axis of each foot support. Further, the angle can be varied in accordance with the reciprocating movement of the left and right foot supports in order to rotate the hip joint for improving flexibility thereof.

Further, the drive unit may be configured to rotate each of the left and right foot supports about its lengthwise axis parallel to the length of the user's foot. In this instance, the device can be easily fitted to a bowlegged or knock-kneed user simply by selecting the angle about the upright axis of the foot support Further, the angle can be varied in accordance with the reciprocating movement of the left and right foot supports in order to strengthen the muscles for curing the bowleg or knock-knee.

Further, the present invention proposes a passive exercise assisting device which is capable of exciting the abductor muscles, adductor muscles and the like to enhance sugar uptake of the muscles for curing type II diabetes. In this instance, a drive unit is incorporated in the device to reciprocate the left and right foot supports in such a manner as to vary a lateral distance between the left and right foot plates with regard to representative points of the left and right foot supports, while allowing each of the left and right foot supports to rotate about its lateral axis parallel to the width direction of the user's foot, thereby varying the angle of the ankle joint. When the angle is set to give the dorsiflextion movement, the device can stretch the Achilles tendon. Further, repeating dorsiflexion and plantarflexion can stretch calf muscles to promote venous return. Since the foot position varies between the dorsiflexion and plantarflexion, the angle of the ankle joint varies in association with the shifting movement of the user's center, which brings about varying weight distribution on the bottom of the foot and consequently induce a large contraction of the associated muscles.

The drive unit may be configured to reciprocate the left and right foot supports in such a manner as to vary a lateral distance between the left and right foot plates with regard to representative points of the left and right foot supports, while allowing each of the left and right foot supports to rotate about its upright axis perpendicular to a top surface of the corresponding one of said left and right foot supports. In this instance, it is possible to reduce the shear force acting on the knee joint upon suitable selection of the angle about the upright axis of each foot support. Further, the angle can be varied in accordance with the reciprocating movement of the left and right foot supports in order to rotate the hip joint for improving flexibility thereof.

The drive unit may be configured to reciprocate the left and right foot supports in such a manner as to vary a lateral distance between the left and right foot plates with regard to representative points of the left and right foot supports, while allowing each of the left and right foot supports to rotate about its lengthwise axis parallel to the length of the user's foot. Also in this instance, the device can be easily fitted to a bowlegged or knock-kneed user simply by selecting the angle about the upright axis of the foot support Further, the angle can be varied in accordance with the reciprocating movement of the left and right foot supports in order to strengthen the muscles for curing the bowleg or knock-knee.

At least one of the left and right foot supports employed in the passive exercise assisting device is preferred to vary its surface angle relative to a horizontal plane within a predetermined range. When the foot support is cause to tilt in the forward/rearward direction, an exercise is made with particular muscles in the lower leg being kept in a tense condition to promote strengthening these muscles. When, on the other hand, the foot support is caused to tilt in the lateral direction, an exercise is made with a condition of curing inward or outward leg distortion such as the bow-leg or knock-knee so as to promote strengthening the muscles for releasing the distortion. For realizing the passive exercise assisting device with a simple structure, it is particularly preferred to use a carrier mounting the left foot support, the right foot support, and the drive unit and to have a top surface of the carrier inclined at a predetermined angle relative to a horizontal plane. With this structure, it is possible to excite the rectus femoris muscles, medial vastus muscles, lateral vastus muscles, bicepts femoris muscles, anterior tibial muscles, and gastrocnemuis muscles, thereby promoting sugar uptake in the muscles for curing type II diabetes.

BEST MODE FOR CARRYING OUT THE INVENTION

First Embodiment

Figure 2:
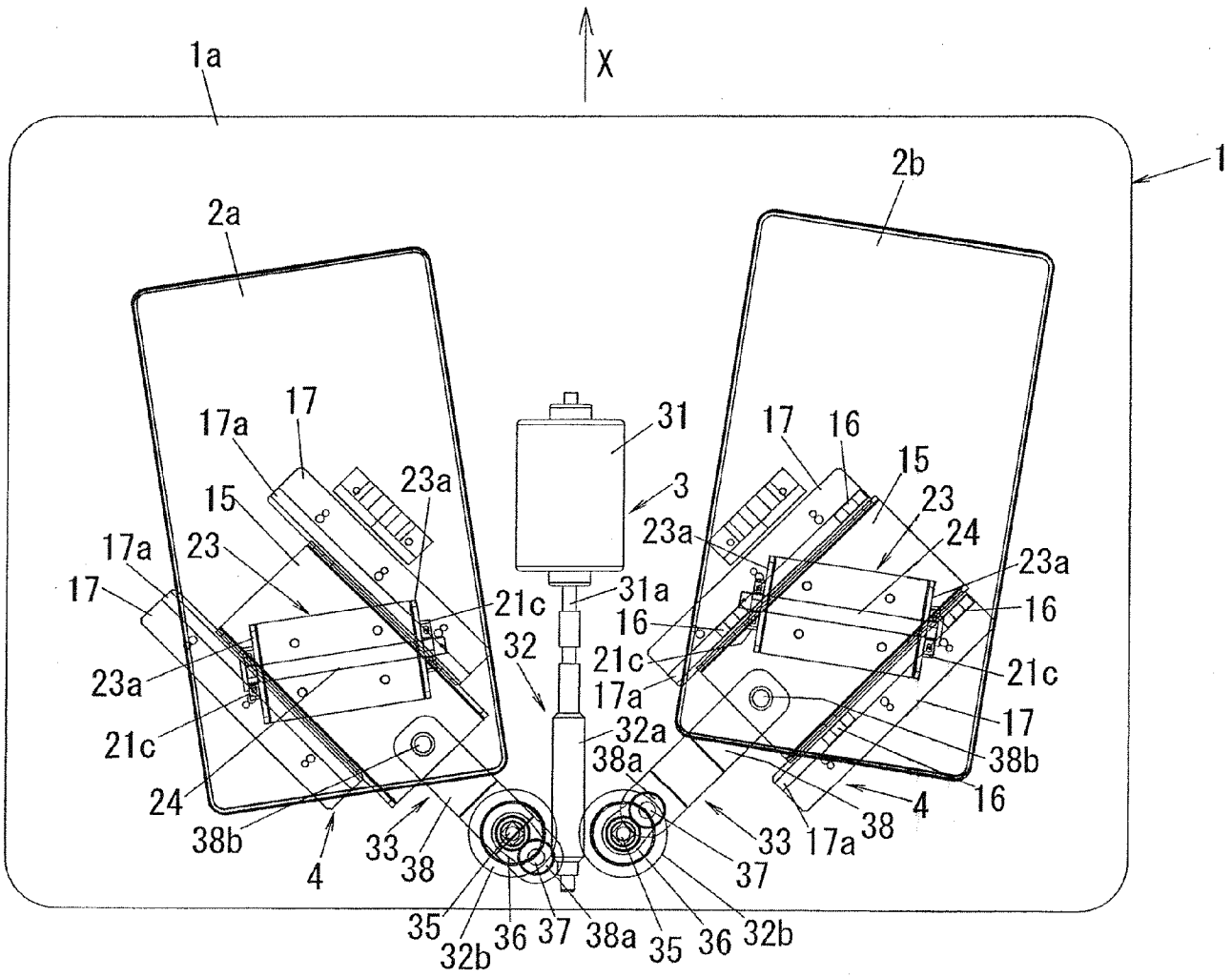
FIG. 2 is a plan view of the above device with an upper plate being removed.
Figure 3:
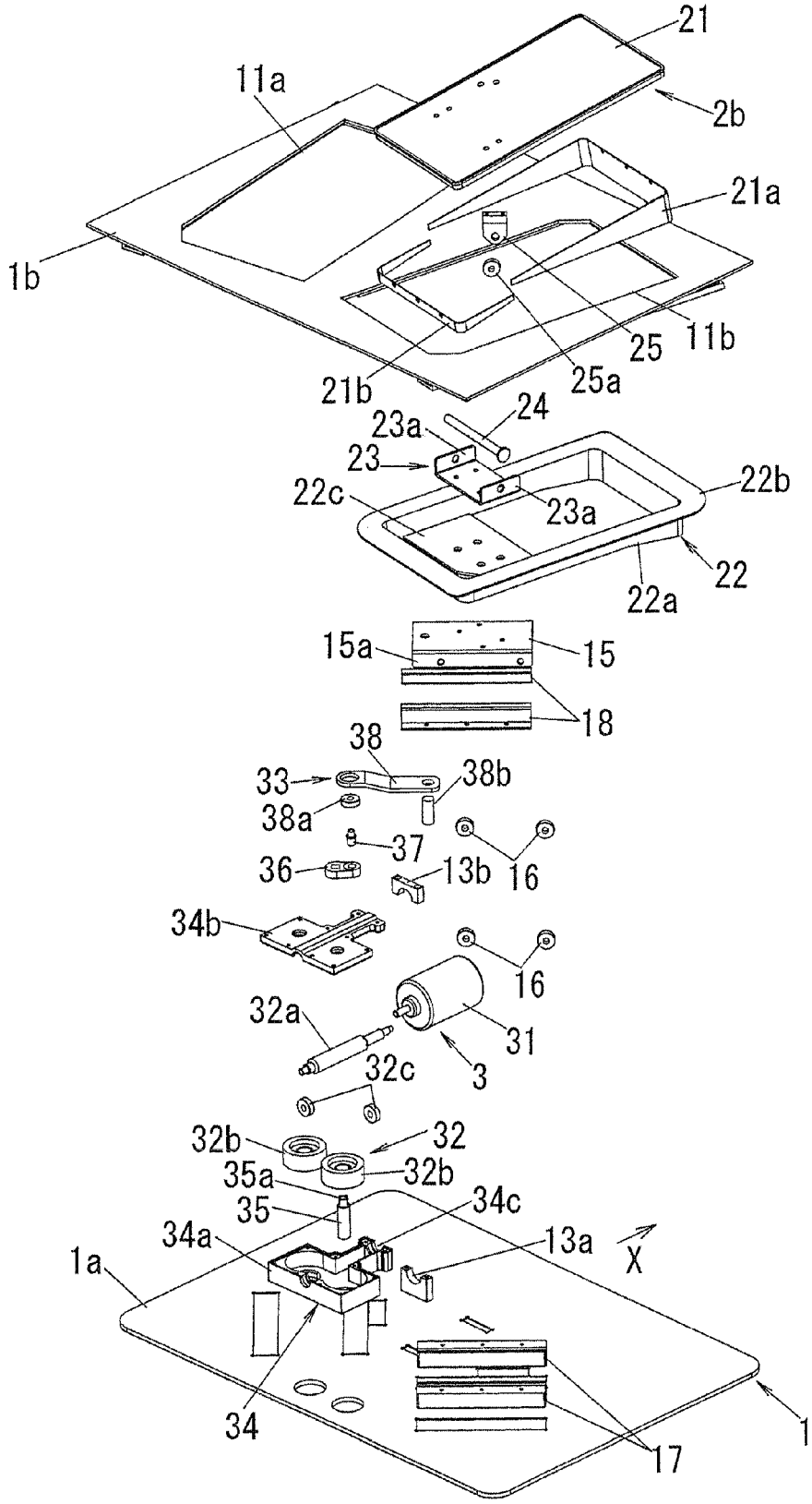
FIG. 3 is an exploded perspective view of the above device.

Referring to FIGS. 2 and 3, there is shown a basic configuration of the present invention. Although the present embodiment illustrates a device adapted in use to be placed on a floor, the device can be used with its portion embedded in the floor. A selection is made as to whether the device is placed at a fixed position or movably supported. The device illustrated hereinafter is basically designed for use by a user in a standing posture, although it can be used by a user in a sitting posture.

The device of the present embodiment has a base plate 1*a* to be placed on the floor, as shown in FIGS. 2 and 3. The base plate 1*a* is configured to have a rectangular shape, although not limited to a peripheral shape. For a simplified explanation made hereinafter, the base plate 1*a* is illustrated to have a top surface parallel to the floor when it is placed on the floor.

An upper plate 1*b* is disposed above the base plate 1*a*, and is coupled thereto to constitute a housing 1 as a carrier. The housing 1 is designed to have a rectangular parallelepiped shave, but may be designed to have an exterior shape of cylinder or polygonal tube with an interior space. Hereinafter, the housing 1 is illustrated to have its top surface (top surface of the upper plate 1*b*, in parallel with the floor when placed on the floor. When used with a portion embedded in the floor, the housing 1 may have a frame structure except for the upper plate 1*b*.

The base plate 1*a* is provided with a left foot support 2*a* and a right foot support 2*b* adapted respectively for bearing left and right feet of a user. Also, a drive unit 3 is disposed on the base plate 1*a* for moving the left and right foot supports 2*a* and 2*b*. It is noted that an arrow X in FIGS. 2 and 3 denotes a forward direction of the device. This applies to any other figure which includes the arrow X. The forward direction indicated by the arrow X is roughly coincidence with a straight direction square to the front of the user.

The upper plate 1*b* is formed with two openings 11*a* and 11*b* extending in a thickness direction of the plate to expose the left and right foot supports 2*a* and 2*b*, respectively. The openings 11*a* and 11*b* are each formed into a rectangular shape. The openings 11*a* and 11*b* have their longitudinal center lines extending in a crossing relation with respect to the forward/rearward direction of the housing 1 such that the distance between the center lines is greater at the front ends of the openings than at the rear ends thereof. The longitudinal direction of each of the openings 11*a* and 11*b* is inclined at a suitable angle relative to the forward/rearward direction of the base plate 1*a*, for example, within a range of 5° to 15°. The angle of the left opening 11*a* is a counterclockwise angle about its rear end, while the angle of the right opening 11*b* is a clockwise angle about its rear end.

Each of the openings 11*a* and 11*b* has an open area greater than the upper surface area of each of the left and right foot supports 2*a* and 2*b*, so that the left and right foot supports 2*a* and 2*b* is movable respectively within the openings 11*a* and 11*b*.

The openings 11*a* and 11*b* have their lengthwise directions respectively aligned with those of the left and right foot supports 2*a* and 2*b*. In use, the user places one's feet on the left and right foot supports with each of the longitudinal center lines of the feet aligned with the lengthwise direction of each foot support. As mentioned in the above, the openings 11*a* and 11*b* have their individual lengthwise center lines angled at 5° to 15° relative to the forward/rearward direction of the base plate 1*a*, such that the user in the standing posture can place the feet respectively on the left and right foot supports 2*a* and 2*b* with one's leg muscles kept relaxed.

Figure 4:
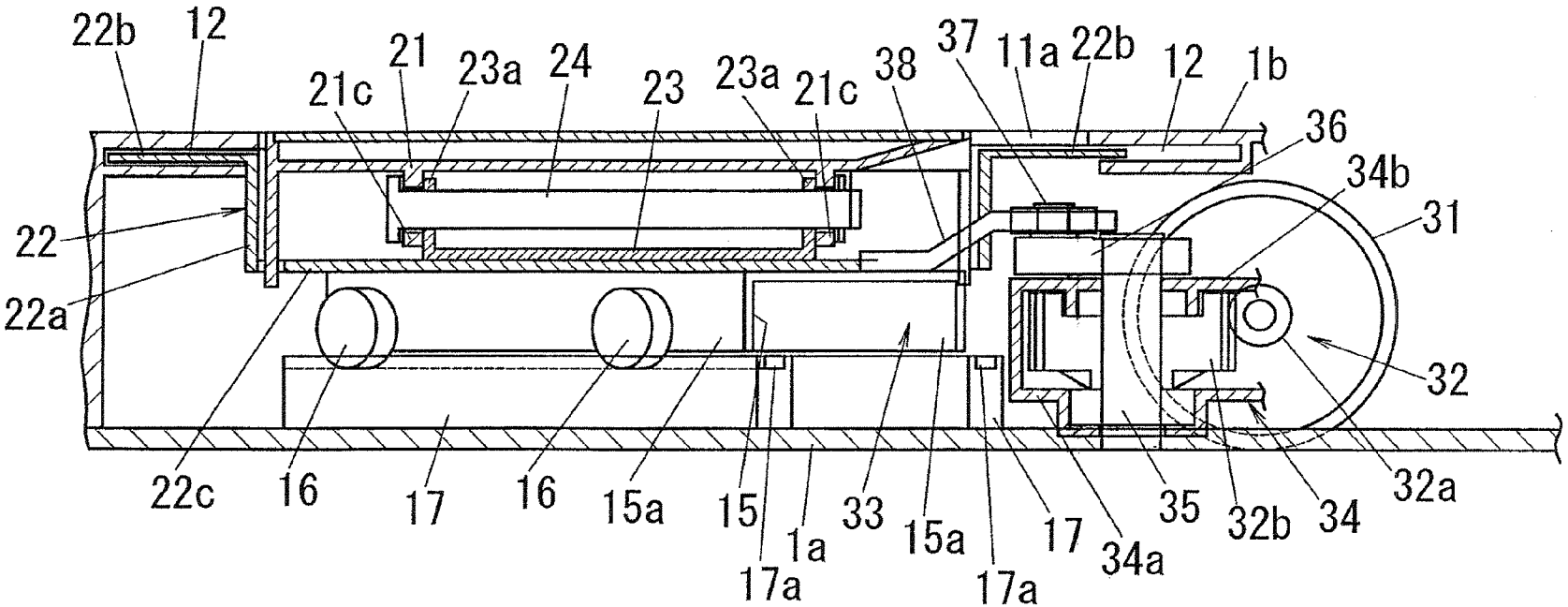
FIG. 4 is a cross-sectional view showing a principal part of the above device.

As shown in FIG. 4, slide grooves 12 are provided on opposite width ends of each of the openings 11*a* and 11*b* in communication therewith for receiving a flange 22*b* formed on each of footrest covers 22. Each of the footrest covers 22 is cooperative with a foot plate 21 to define each of the left and right foot supports 2*a* and 2*b*, and is composed of a main section 22*a* in the shape of a rectangular barrel and is formed with the flange 22*b* extending around an open face (upper face) over the entire periphery of the main section 22*a*. The footrest cover 22 has an integrally formed attachment plate 22*c* at a lower end within the main section 22*a*.

The main section 22*a* has its lengthwise as well as the width dimensions respectively less than those of the openings 11*a* and 11*b*, while the flange 22*b* has such dimensions larger than those of the openings 11*a* and 11*b*. Further, the slide groove 12 has its opposed bottom spaced by a distance greater than a corresponding distance between the opposite edges of the flange 22*b*. Thus, the footrest cover 22 is allowed to move within the confines of the slide groove 12 with respect to the width as well as lengthwise direction thereof.

The foot plate 21 is formed into a rectangular plate slightly smaller than the inner periphery of the main section 22*a* of the footrest cover 22 to have such dimensions as to bear the entire foot of the user. The foot plate 21 is made of a material or shaped to have a large coefficient of friction. The foot plate 21 is integrally formed around its lower periphery with generally U-shaped cover members 21*a* and 21*b*. The foot plate 21 is integrally formed on its bottom at a portion surrounded by the cover members 21*a* and 21*b* with a pair of bearings 21*c* spaced in the width direction of the foot plate 21.

A bearing plate 23 of U-shaped cross section is fixed to the top of the attachment plate 22*c* of the footrest cover 22 to have its open end oriented upwardly, and has its opposed legs 23*a* in contact respectively with the outer faces of the bearing 21*c* of the foot plate 21. An axle 24 penetrates through the legs 23*a* of the bearing plate 23 and the bearings 21*c* to extend in the width direction of the foot plate 21. The foot plate 21 is allowed to swing about the axle 24 in such a manner that the foot plate 21 moves up and down at its lengthwise forward and rearward ends. The cover members 21*a* and 21*b* are provided to conceal a gap formed between the foot plate 21 and the footrest cover 22 while the foot plate 21 swings relative to the footrest cover 22.

Figure 5:
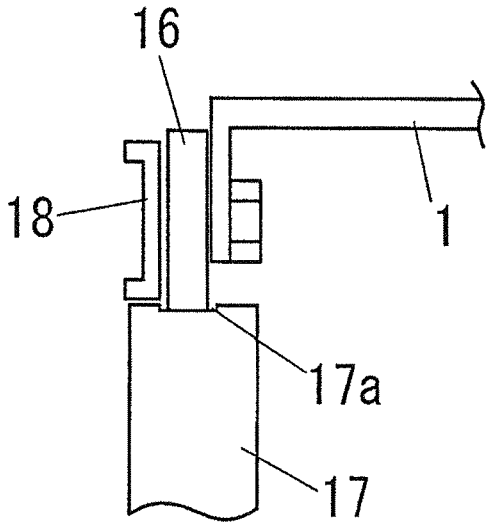
FIG. 5 is an enlarged view showing a principal part of the above device.

A truck 15 of U-shaped cross section is fixed to the bottom of the attachment plate 22*c* of the footrest cover 22 to have its open end oriented downwardly, and is provided on each exterior face of its legs 15*a* with two wheels 16. The base plate 1*a* is formed with two fixed rails 17 for each of the left and right foot supports 2*a* and 2*b* such that the truck 15 is placed on the rails 17 with the wheels 16 roll in the rail grooves 17*a* in the upper end of the rails 17. A derailment prevention plate 18 is provided on top of the rail 17 for preventing the wheels 16 from running off the rail grooves 17*a* (see FIG. 5).

The rails 17 extend in a direction different from the lengthwise direction of the openings 11*a* and 11*b* in the housing 1. As described in the above, the openings 11*a* and 11*b* have their individual longitudinal center lines crossed with each other so as to be spaced by a larger distance at the forward ends than at the rearward ends. Also, the rails 17 have their individual longitudinal directions crossed with each other in the like manner.

However, the rails 17 are inclined in relation to the forward/rearward direction of the housing 1 at a large angle than the openings 11*a* and 11*b*. For example, when the openings 11*a* and 11*b* have their lengths inclined relative to the forward/rearward direction of the housing 1 at an angle of 15°, the rails 17 have its length inclined at an angle of 45°. In short, the rails 17 are oriented to such a direction as to prevent an increase of shearing force acting on the knee joints while the left and right foot supports 2*a* and 2*b* are moved along the rails 17 in a condition that the user's feet are placed thereon with each center line of the feet aligned with each of the length of the openings 11*a* and 11*b*.

With the above arrangement, the left and right foot supports 2*a* and 2*b* are allowed to move respectively along the lengths of the rails 17. Because of that the rails 17 have their lengths crossed respectively with the lengthwise center lines of the openings 11*a* and 11*b*, the foot plate 21 and the footrest cover 22 are allowed to move within the openings 11*a* and 11*b* along the directions crossing with the lengthwise direction of the openings 11*a* and 11*b*.

Although the present embodiment illustrates a preferred mode that the left and right foot supports 2*a* and 2*b* are moved along the individual travel paths of shifting their positions both in the forward/rearward direction and the lateral direction, it is possible to determine the orientation of the rails 17 such that the left and right foot supports 2*a* and 2*b* are moved either in the forward/rearward direction or the lateral direction.

Figure 6:
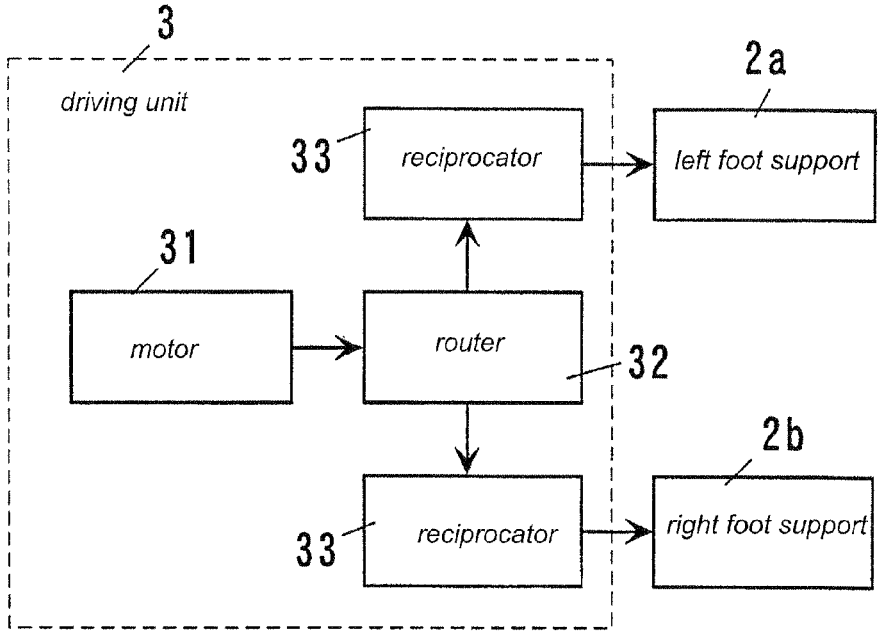
FIGS. 6(*a*) and 6(*b*) are system diagrams showing a drive unit employed in the above device.
Figure 6:
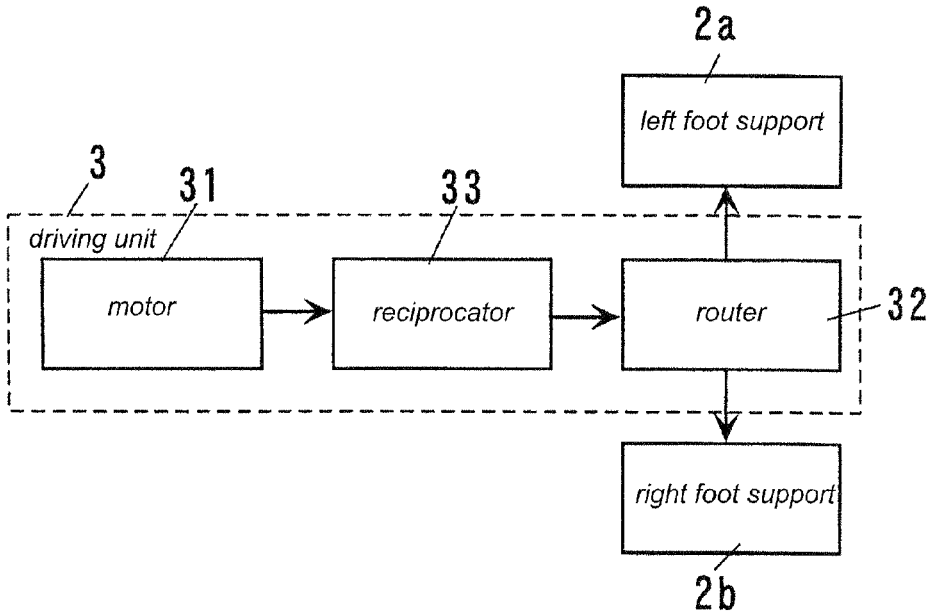

Accommodated within a space in the housing 1 between the base plate 1*a* and the upper plate 1*b* is a drive unit 3 which shifts the positions of the left and right foot supports 2*a* and 2*b* relative to the housing 1. As shown in FIG. 6, the drive unit 3 includes an electric motor 31 as a driving source of generating a rotary driving force, a router 32 for transmitting the rotary driving force of the motor 31 to the left and right foot supports 2*a* and 2*b*, and reciprocators 33 for using the driving force to reciprocate the trucks 15 respectively along the rails 17. Although the present embodiment is configured to divide the driving force at the router 32 and transmit the divided driving force to the reciprocators 33, as shown in FIG. 6(*a*), it is equally possible to generate the reciprocating driving force at the reciprocator 33 and divide the same at the router 32, as shown in FIG. 6(*b*).

Details of the drive unit 3 are now explained. The router 32 includes a worm 32*a* coupled to an output shaft 31*a* of the motor 31, and a pair of worm wheels 32*b*. The worm 32*a* and the two worm wheels 32*b* are held within a gearbox 34 fixed to the base plate 1*a*. The gearbox 34 is composed of a gear case 34*a* with a top opening, and a lid 34*b* fitted in the opening of the gear case 34*a*. A pair of bearings 32*c* is mounted between the gear case 34*a* and the lid 34*b* to bear the opposite longitudinal ends of the worm 32*a*.

With this arrangement, the rotary force of the motor 31 is divided by way of the two worm wheels 32*b* into the individual rotary forces which are respectively utilized to drive the left and right foot supports 2*a* and 2*b*. The router 32 thus composed of the worm 32*a* and the worm wheels 32*b* functions also to reduce the rotational speed of the motor 31.

Extending through the worm wheel 32*b* is a rotary shaft 35 which is held by the gear case 34*a* and the lid 34*b* and is coupled to the worm wheel 32*b* to be driven thereby to rotate. The rotary shaft 35 is formed at its upper end with a coupling section 35*a* with non-circular cross-section (rectangular one in the illustrated instance), The motor 31 is mounted on a holder member 34*c* of the gear case 34*a* and on a holder plate 13*a* secured to the base plate 1*a*, and is fixed to the base plate 1*a* by means of the lid 34*b* fitted over the gear case 34*a* and a retainer plate 13*b* coupled to the holder plate 13*a*.

Figure 7:
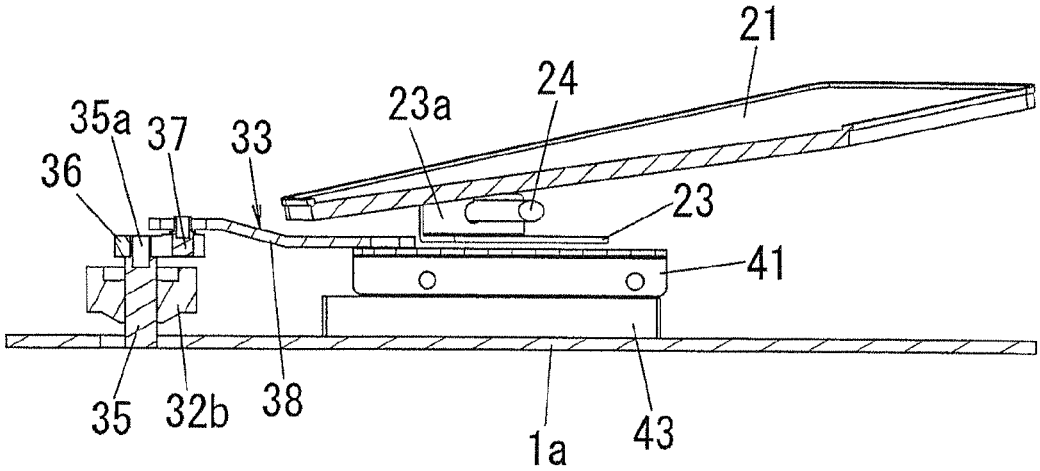
FIG. 7 is a cross-sectional view showing a principal part of the above device.

As shown in FIG. 7, the reciprocator 33 includes a crank plate 36 coupled at its one end to the coupling section 35*a* of the rotary shaft 35, and a crank rod 38 coupled to the crank plate 36 by means of a crank shaft 37. The crank shaft 37 has its one end fixed to the crank plate 36 and has the other end received in the bearing 38*a* carried on one end of the crank rod 38. That is, the crank rod 38 has its one end rotatively coupled to the crank plate 36, while the other end of the crank rod 38 is coupled to the truck 15 by means of an axle 38*b* so as to be rotatively coupled thereto.

As is apparent from the above, the crank rod 38 functions as a motion converter to translate the rotary motion of the worm wheel 32*b* into a reciprocatory motion of the truck 15. Since the crank rod 38 is provided for each of the worm wheels 32*b* and the trucks 15 are provided respectively to the left and right foot supports 2*a* and 2*b*, the crank rods 38 function as the individual motion converters for translating the rotary motion of the worm wheels 32*b* into the reciprocating motions of the left and right foot supports 2*a* and 2*b*.

As described in the above, the truck 15 has its travel path restricted by the wheels 16 and the rails 17 so that the truck 15 reciprocate along the length of the rails 17 as the worm wheel 32*b* rotates. That is, the rotation of the motor 31 is transmitted to the crank plate 36 by way of the worm 32*a* and the worm wheel 32*b*, so that the crank rod 38 coupled to the crank plate 36 causes the truck 15 to reciprocate linearly along the rails 17. Whereby, the left and right foot supports 2*a* and 2*b* are driven to reciprocate respectively along the length of the rails 17.

In the present embodiment, the worm 32*a* and the two worm wheels 32*b* are responsible for routing the driving force into two channels respectively for driving the left and right foot supports 2*a* and 2*b* so that the drive unit 3 drives the left and right foot supports 2*a* and 2*b* in a manner linked to each other. The worm wheels 32*b* are engaged with the worm 32*a* at different portions spaced apart by 180° such that the right foot support 2*b* comes to the forward end of its movable range when the left foot support 2*a* comes to the rear end of its movable range. As the left foot support 2*a* comes to the right end of its movable range when it comes to the rear end of the movable range, and the right foot support 2*b* comes to the right end of its movable range when it comes to the forward end of the movable range, the left and right foot supports 2*a* and 2*b* shift in the same direction along the lateral direction.

As apparent from the above, it is possible to give a desired phase difference of the movement between the left and right foot supports 2*a* and 2*b* by varying positions of engaging the worm wheels 32*b* with the worm wheels 32*b*. When the device is used by the user at the standing posture with one's feet placed on the left and right foot supports 2*a* and 2*b*, the phase difference of 180° is effective to minimize the shifting of the user's weight in the forward/rearward direction, enabling the exercise even by the user suffering from lowered balancing capability. Alternatively, when no phase difference is given, the device necessitates the shifting movement of the user's weight in the forward/rearward direction, thereby developing an exercise not only for the leg muscles but also for lower back muscles of the user maintaining the balancing capability.

It is noted in this connection that the housing 1 defines a specific frame coordinate system which has a vertical dimension perpendicular to the top face of the housing 1, a forward dimension extending in a plane perpendicular to the vertical dimension in correspondence to a straight forward direction square to the front of the user whose feet are placed on the left and right foot supports 2*a* and 2*b*, and a lateral dimension extending in the plane perpendicular to the vertical dimension in correspondence to a direction perpendicular to the forward/rearward direction, i.e., the right-and-left direction of the user.

As described in the above, the upper face of the foot plate 21 (i.e., the upper faces of the left and right foot supports 2*a* and 2*b*) is formed of the material or shaped to have increased coefficient of friction, it is possible to avoid slipping of the feet off the left and right foot supports 2*a* and 2*b* while the supports are driven to move relative to the housing 1. An anti-slipping structure may be added to hold the feet respectively on the left and right foot supports 2*a* and 2*b*. For instance, a foot instep catch as in a slipper or foot instep and heel strap as in a sandal may be utilized. When the device is intended for use by the user with shoes, a binding of fixing the shoe can be utilized.

When the device includes the structure of fixing the position of the feet on the left and right foot supports 2*a* and 2*b*, and is further configured to adjust the foot positions relative to the left and right foot supports 2*a* and 2*b*, respectively, i.e., when the fixing members of the feet to the left and right foot supports 2*a* and 2*b* are made adjustable along the length of the supports, it is possible to give a differing travelling distance between the movement from a neutral position to the forward end position and the movement from the neutral position to the rearward end position.

Individual support coordinate systems are defined respectively to the left and right foot supports 2*a* and 2*b* in a like fashion as the housing 1 does. Each of the support coordinate systems given to the left and right foot supports 2*a* and 2*b* has a vertical which has a vertical dimension perpendicular to the top face of the support, a forward dimension extending in a plane perpendicular to the vertical dimension in correspondence to a straight direction leading from the user's heel to the toe, and a lateral dimension extending in the plane perpendicular to the vertical dimension in correspondence to a direction perpendicular to the forward/rearward direction, i.e., the width direction of the foot of the user.

In order to explain the movements of the left and right foot supports hereinafter, a representative point is defined for each of the left and right foot supports 2*a* and 2*b*. As will be explained later, the left and right foot supports 2*a* and 2*b* is each made capable of varying an inclination angle of its upper face relative to the upper face of the housing 1, the representative point is selected to a point which does not fluctuate with varying inclination angle. Although there may be plural points as a candidate for the representative point, any one of the points is suffice, and even a point outside of each of the left and right foot supports 2*a* and 2*b* may be set as the representative point. With the definition of the representative point, the left and right foot supports 2*a* and 2*b* can be comprehensively described with regard to their travelling paths.

As apparent from the above, the drive unit 3 is configured to vary the positions of the left and right foot supports 2*a* and 2*b* along the forward/rearward direction as well as the lateral direction within the frame coordinate system given to the housing 1. Also, the left and right foot supports 2*a* and 2*b* are not driven individually to move, but instead driven by way of the transmission mechanism (router 32*b* and the reciprocators 33) which transmits the driving force from the motor 31 as the driving source to the left and right foot supports 2*a* and 2*b* in order to move the left and right foot supports in the linked fashion. With this linked movement between the left and right foot supports 2*a* and 2*b*, it is possible to reduce a number of parts constituting the driving source at a sacrifice of reducing freedom of patterned motions. However, It is equally possible to use a plurality of driving sources to give the linked movement to the left and right foot supports 2*a* and 2*b*. Further, the drive unit 3 may be configured to combine the above two driving schemes.

The left and right foot supports 2*a* and 2*b* are configured to vary its inclination angle relative to the upper face of the housing 1. For this purpose, the drive unit 3 is configured to vary the inclination angle at the representative point for each of the left and right foot supports 2*a* and 2*b*, in addition to moving the left and right foot supports 2*a* and 2*b* along the forward/rearward direction as well as the lateral direction. The inclination angle of each of the left and right foot supports 2*a* and 2*b* relative to the upper face of the housing 1 is made variable about at least one of the longitudinal axis and the lateral axis both passing through the representative point within the corresponding support coordinate system. In addition, each of the left and right foot supports may be made to have a varying angle about the upright axis.

When varying the inclination angle about the longitudinal axis within the support coordinate system, it is possible to stretch the Achilles tendon at the dorsiflexion for expanding a movable range of the ankle, and also to concentrate the force to the toe at the plantarflexion for mitigating hallux valgus. When the inclination angle about the longitudinal axis is varied with elapse of time, it is possible to stretch the lower leg muscles including gastrocnemuis muscle and soleus muscles. Stretching of these muscles increases venous return in the leg to thereby reduce leg swelling.

When varying the inclination angle about the lateral axis within the support coordinate system for each of the left and right foot supports 2*a* and 2*b*, the knock-kneed or bowlegged user is allowed to use the device with one's knee in a corrected posture. Further, when varying the angle about the upright axis with elapse of time, the hip joint is caused to swing for enhancement of its flexibility. Also when varying the angle about the upright axis, the user can use the device free from receiving the shearing force at the knee joints Now, explanation is made to the motion patterns of the left and right foot supports 2*a* and 2*b* as well the operation of the drive unit 3 with reference to the frame coordinate system in which the forward/rearward, the lateral, and the upright directions are respectively denoted by X-, Y- and Z-directions. It is also referred to the support coordinate system for each of the left and right foot supports 2*a* and 2*b*, in which the forward/rearward, lateral, and upright directions are denoted respectively by x-, y-, and z-directions. Consequently, the housing 1 has its upper face parallel to parallel to X-Y plane, and the representative points of the left and right foot supports 2*a* and 2*b* moves within a plane parallel to the X-Y plane. The left and right foot supports 2*a* and 2*b* moves with its y-direction of the support coordinate system aligned with the Y-direction of the frame coordinate system, while being allowed to vary the angle only about an axis Ay along the y-direction (refer to FIG. 8). That is, the left and right foot supports 2*a* and 2*b* are allowed to rotate about the axis Ay.

When using the device, the user is firs required to stand with one's feet placed respectively on the left and right foot supports 2*a* and 2*b* which are rest respective at their initial positions and then to start the drive unit 3. A switch for staring the drive unit 3 is preferably provided on the side of a wireless remote controller using an infrared ray or wired remote controller connected to a wire extending from the housing 1, in view of that the provision of a manual switch on the side of the housing 1 requires the user to bend down for operation of the switch and is therefore inconvenient. Alternatively, a foot-operated switch may be provided on either one of the left and right foot supports 2*a* and 2*b*. Further, an automated switch may be provided to detect a condition where the user's feet are placed respectively on the left and right foot supports 2*a* and 2*b* for automatically activating the drive unit 3 with a constant time delay after such detection.

The drive unit 3 is preferred to be gradually accelerated when starting the operation and to be gradually decelerated when stopping the operation in order to avoid the user from significantly losing balance which would be otherwise critical when there is large speed variation. Further, the left and right foot supports 2*a* and 2*b* are configured to rest horizontally at the positions or at such respective angles about the axis Ay that the left and right foot supports 2*a* and 2*b* are symmetrically inclined. Whereby the user can stably ride on and off from the left and right foot supports 2*a* and 2*b* at their rest positions without having to tilt the body trunk.

Figure 1:
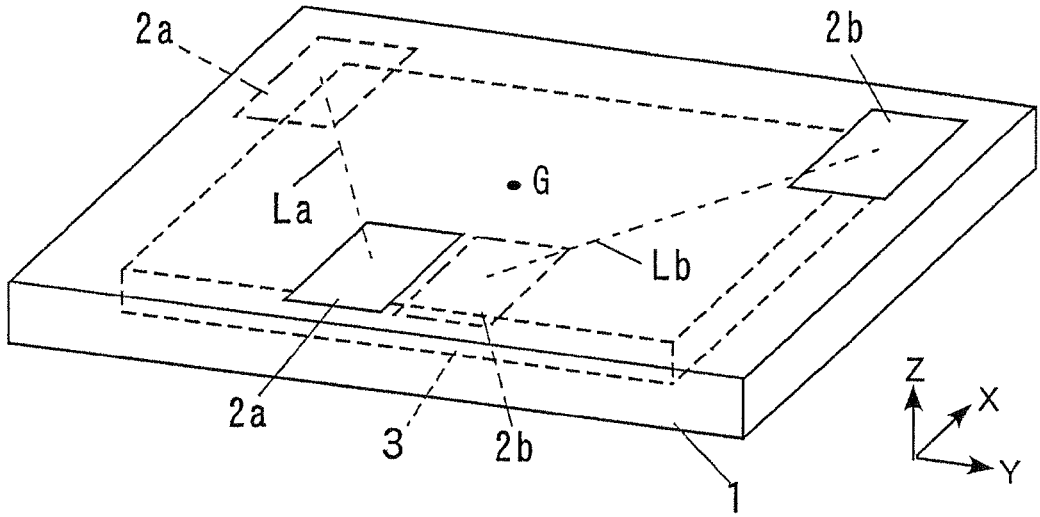
FIG. 1 is a schematic diagram showing a passive exercise assisting device in accordance with a first embodiment of the present invention.
Figure 8:
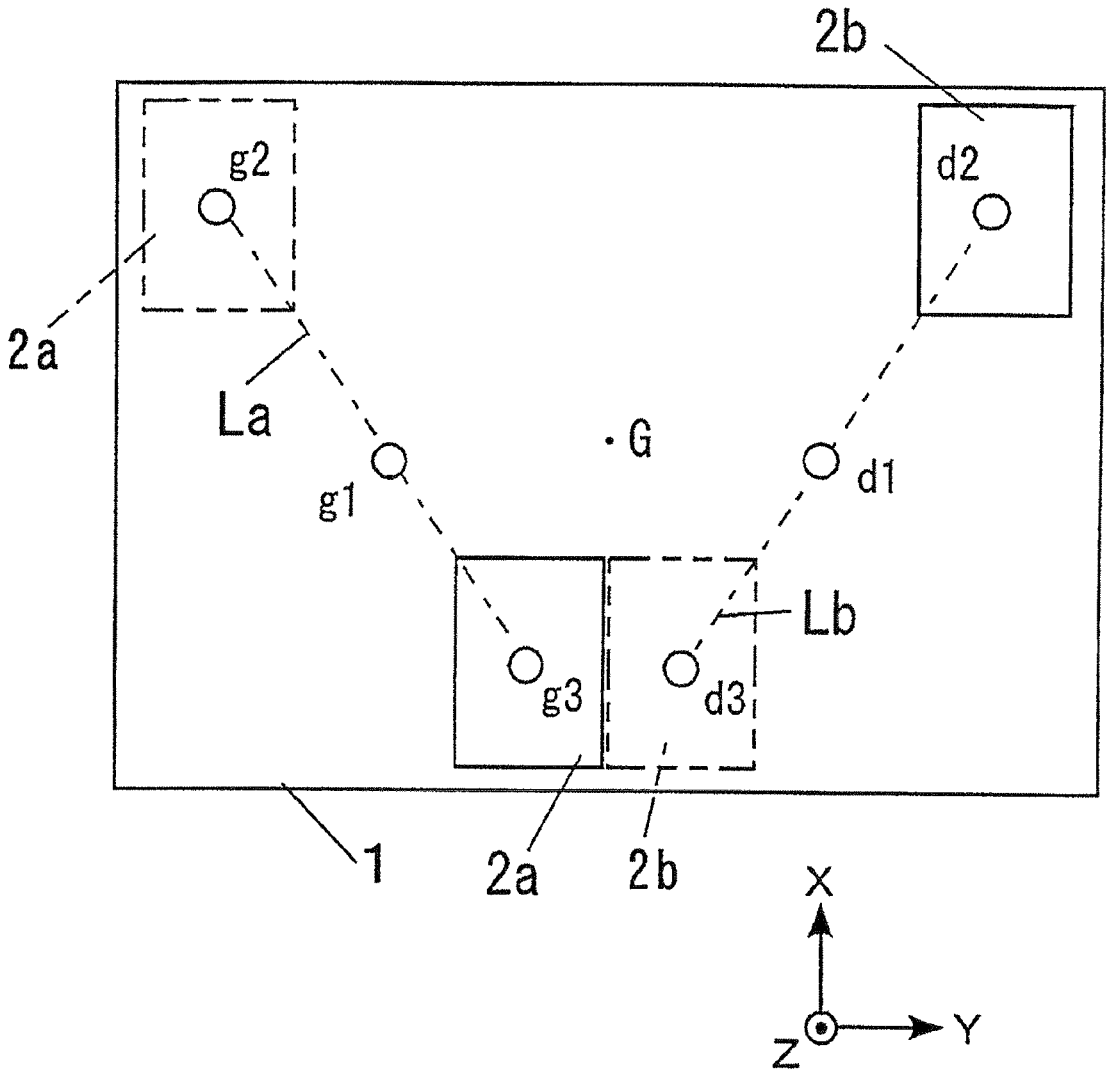
FIG. 8 is an explanatory view showing an operation of the above device.

At the initial positions, the left and right foot supports 2*a* and 2*b* are located at the same level along the forward/rearward direction. That is, the representative points of the left and right foot supports 2*a* and 2*b* lie on a line extending along the lateral direction when they are at the initial positions. Accordingly, when the user stands on the left and right foot supports 2*a* and 2*b* of the initial positions, a vertical line depending from the weight center of the user passes through a center between the left and right foot supports 2*a* and 2*b*. In FIGS. 1 and 8, a point G denotes a crossing point between the vertical line depending from the user's weight center and the upper face of the housing 1.

The drive unit 3 varies the positions of the left and right foot supports 2*a* and 2*b* along the forward/rearward direction as well as the lateral positions of the same in association with the varying positions along the forward/rearward direction. In addition, the drive unit 3 gives cyclic movements both along the forward/rearward direction and the lateral direction within predetermined ranges. In this context, the cyclic movement means that the foot support passes the same position cyclically.

The present embodiment is configured to adopt the motion pattern of FIG. 1 in which the representative points of the left and right foot supports 2*a* and 2*b* reciprocate along the travel paths La and Lb within the plane parallel to the X-Y plane. The travel path La of the left foot support 2*a* and the travel path 1*b* of the right foot support 2*b* are cooperative to form a V-shape configuration in which the paths are spaced in the lateral direction by a greater extent at their forward ends than at their rearward ends. The travel paths La and Lb are set to have their respective forward ends forwardly of the initial positions, and their rearward ends rearwardly of the initial positions.

The left and right foot supports 2*a* and 2*b* are driven to move in opposite phase relation to each other with respect to the forward/rearward direction such that the user's weight center is maintained at a constant position with respect to the forward/rearward direction (X-direction) within the frame coordinate system, i.e., the point G does not move in the X-direction. The opposite phase relation means that the right foot support 2*b* comes to the rearward end position when the left foot support 2*a* comes to the forward end position, and the right foot support 2*b* comes to the forward end position when the left foot support 2*a* comes to the rearward end position.

Since the left and right foot supports 2*a* and 2*b* are delimited to trace the travel paths La and Lb arranged in the V-shape configuration, and to move in the opposite phase relation to each other with respect to the forward/rearward direction, the left and right foot supports 2*a* and 2*b* move in a phase relation with respect to the lateral direction. That is, the right foot support 2*b* is moving to the right when the left foot support 2*a* is moving to the right, and the right foot support 2*b* is moving to the left when the left foot support 2*a* is moving to the left.

Consequently, when referring to the individual representative points of the left and right foot supports 2*a* and 2*b* which have the initial positions g1 and d1, forward end positions g2 and d2, and the rearward end positions g3 and d3, as shown in FIG. 8, the right foot support 2*b* moves along the travel paths of d1-d3-d1-d2-d1, while the left foot support 2*a* moves along the travel paths of g1-g2-g1-g3-d1.

As described in the above, the left and right foot supports 2*a* and 2*b* have their forward end positions respectively forwardly of the initial positions and have their rearward end positions respectively rearwardly of the initial positions, and are driven to move in the opposite phase relation to each other. Thus, the foot positions vary in much the same way as in the walking to thereby stretch at least the lower legs muscles as in the walking. Further, since the rear end positions are located behind the initial positions and are therefore behind the user's weight center, it is possible to give a strain to the muscles extending from the back of the femoral region to the hip when the foot supports come to the rearward end positions.

In contrast to the general walking exercise in which the foot positions shift mainly along the forward/rearward direction, the device of the present embodiment gives a combined motion both along the forward/rearward direction and the lateral direction, enabling to stretch the lower and femoral muscles in coordination and therefore stretch many associated muscles for increasing the amount of sugar uptake into the muscles even through a passive and light load exercise and therefore improving the curing effect of type II diabetes.

As opposed to an instance where the left and right foot supports 2*a* and 2*b* are driven to move only along the forward/rearward direction with an accompanied reflex action of stretching the hip, knee, and ankle joints for stimulating the lower leg and the hip muscles, the device of the present embodiment adds the movement along the lateral direction to the movement along the forward/rearward direction to realize the V-shaped travel paths La and Lb, and move the left and the right foot supports in the opposite phase relation so as to twist the user's body trunk for stimulating the viscera. Further, the combination movement along the forward/rearward direction and the lateral direction is responsible for stimulating larger number of the muscles (such as adductor muscle, rectus femoris muscle, medial vastus muscle, lateral vastus muscle, biceps femoris muscle, semitendinosus muscle, and semimembranosus muscle) than the single movement either along the forward/rearward direction or the lateral direction.

In order to twist the user's body trunk, the travel paths La and Lb may be arranged to give an inverted V-shape instead of the above mentioned V-shaped arrangement. That is, the left and right foot supports 2*a* and 2*b* are arranged to move their representative points along the travel paths La and Lb which are spaced laterally by a smaller distance at the forward end positions than at the rearward end positions. Also in this instance, the left and right foot supports 2*a* and 2*b* are driven to move in the opposite phase relation along the forward/rearward direction to achieve the same effects as in the above configuration.

Figure 9:
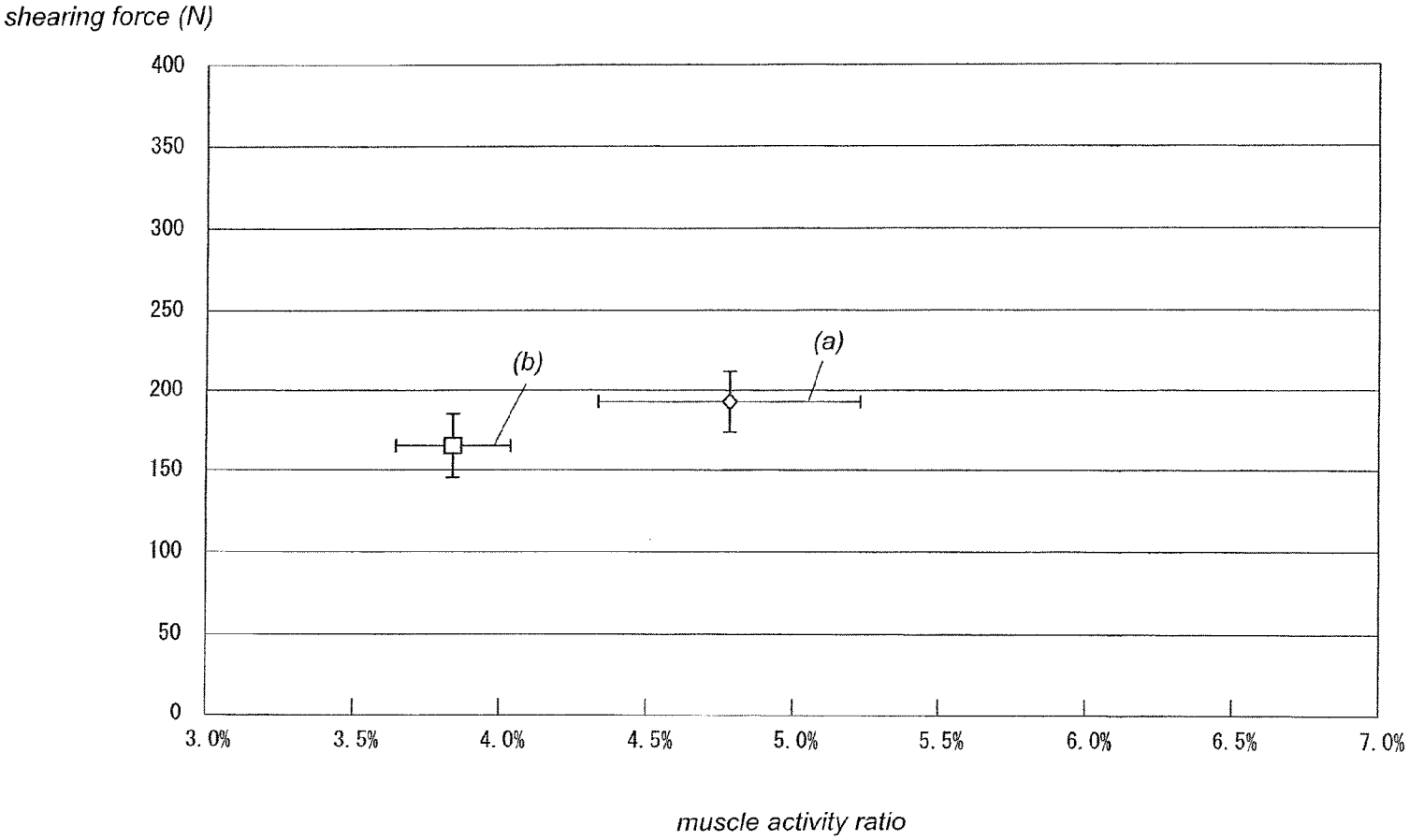
FIG. 9 illustrates an effect of the above device.

FIG. 9 illustrates a relationship between a muscle activity ratio (whole leg) and a shearing force (unit N) acting on the knee joint when the left and right foot supports 2*a* and 2*b* are driven to move in the opposite phase relation in the V-shaped motion pattern and the inverted V-shaped motion pattern. The relation for the V-shaped motion pattern and the inverted V-shaped motion pattern are respectively designated by the sign "(a)", and "(8*b*)" in FIG. 9. A crossing point of the cross indicates an average value, horizontal line of the cross indicates a range of variation in the muscle activity ratio, and vertical line of the cross indicates a range of variation in the shearing force. From this, it is known that the shearing force acting on the knee joint sees no substantial difference between the V-shaped motion pattern and the inverted V-shaped motion pattern, except that the V-shaped motion pattern results in a higher muscle activity ratio than the inverted V-shaped motion pattern. Accordingly, the V-shaped motion pattern is preferable for muscle strengthening.

Figure 10:
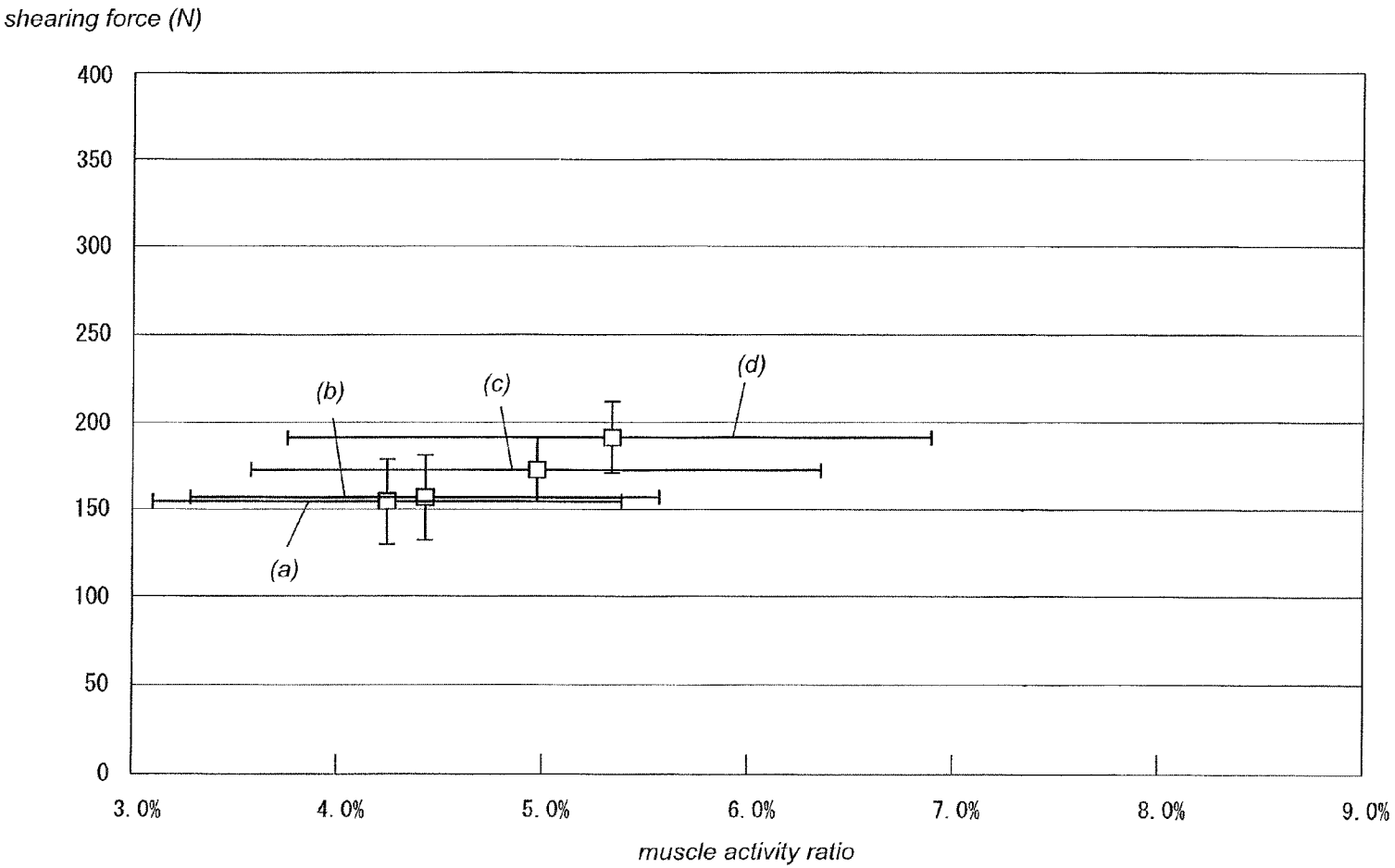
FIG. 10 illustrates an effect of the above device.

FIG. 10 illustrates the relationship between the muscle activity ratio and the shearing force acting on the knee joint when the left and right foot supports 2*a* and 2*b* are driven to move respectively along the travel paths La and Lb, while changing the angle of the paths relative to the forward/rearward direction. The path with an angle of 0° is parallel to the forward/rearward direction, and the path with an angle of 90° is parallel to the lateral direction. The angle is measured in a counter-clockwise for the path of the left foot support, and in a clockwise for the path of the right foot support. In FIG. 10, the crosses labeled with "(a)", "(b)", "(c)", and "(d)" show the relationships respectively for the angles of 0°, 30°, 45°, and 75°. Although the shearing force and the muscle activity ratio see no significant difference within this range of the angle, both of them will increase slightly as the increase of the angle. Accordingly, the angle is made greater for the user free from knee pain so as to increase the muscle activity ratio, while the angle is made smaller for the user suffering from knee pain. When the angle of 90° is selected, the muscle activity ratio sees the same as the angle of 60° while the shearing force sees the same as the angle of 75°. Although FIG. 10 demonstrates the muscle activity ratio in terms of the whole leg, it is estimated that various portions of the leg exhibits the muscle activity ratio varying with the angle.

Figure 11:
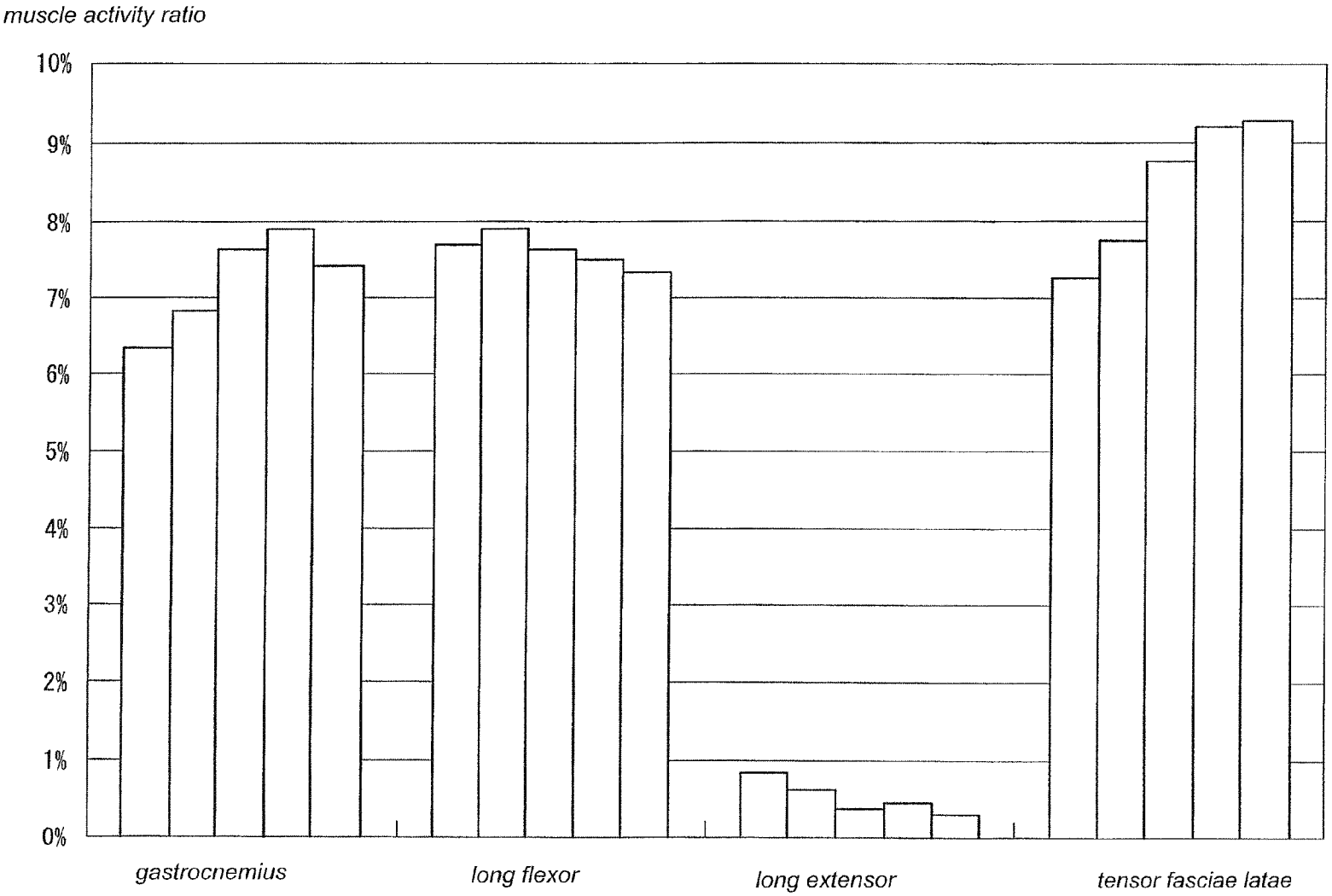
FIG. 11 illustrates an effect of the above device.

FIG. 11 illustrates the muscle activity ratio in relation to the varying angle for typical muscles in various portions of the leg. The angle is varied in 5-steps for each of the muscles, and the muscle activity ratio is shown for each of the muscles with varying angle of 0°, 15°, 45°, 60°, and 90° (in the this order from left to right in the figure). As shown in FIG. 11, the hip muscles as well as the muscle groups for adduction and abduction (for instance, tensor fasciae latae) see the muscle activity ratio higher as the increase of the angle While, on the other hand, the lower leg muscles (for instance, gastrocnemius) sees the higher muscle activity ratio around the angle of 45°. It is noted in this connection that the muscle groups relating the toe (for instance, long flexor of toes and long extensor of the toes) see the muscle activity ratio which tends to become higher as the angle decreases.

Figure 12:
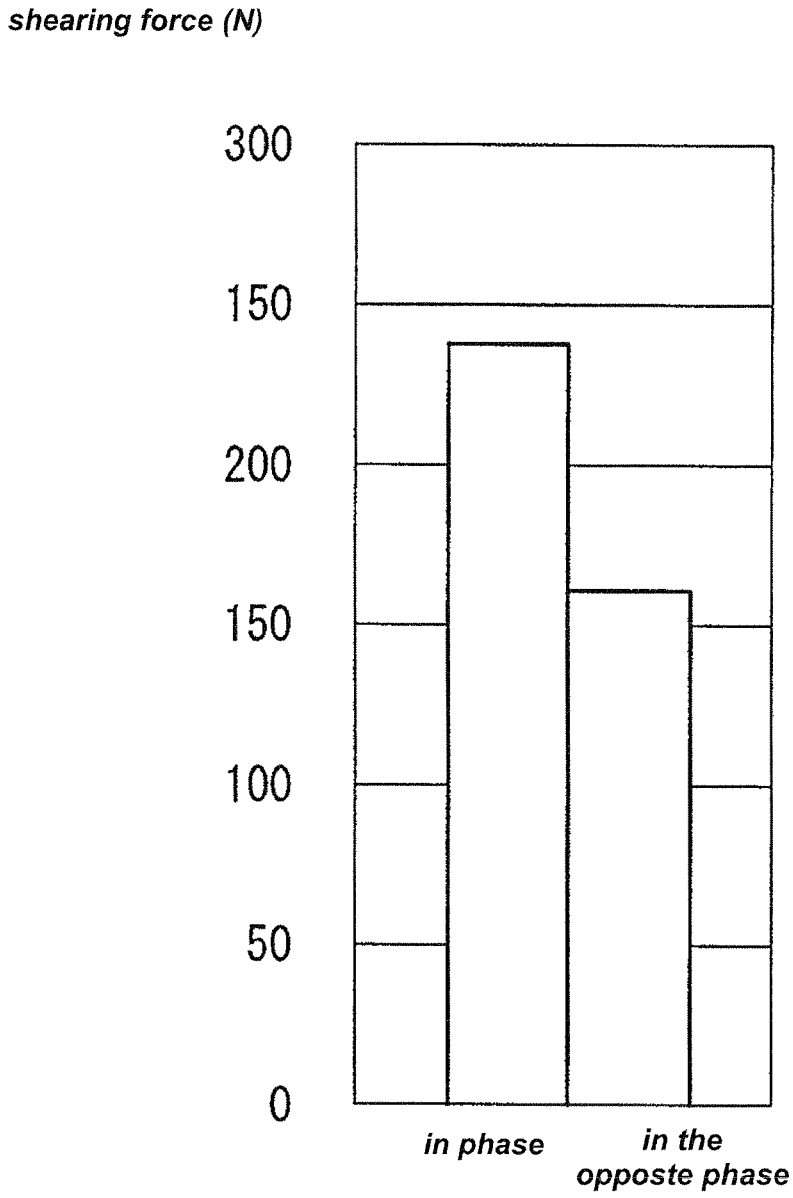
FIG. 12 illustrates an effect of the above device.

The shearing force acting on the knee joint differs when the left and right foot supports 2*a* and 2*b* are driven to move in the same phase relation with each other than when they are driven to move in the opposite phase relation. FIG. 12 illustrates the shearing forces with the foot supports moving in the V-shaped motion pattern respectively in the same phase relation (left bar in the figure) and in the opposite phase relation (right bar in the figure). From the comparison of the illustrated result, the shearing force is smaller when moving the foot supports in the opposite phase relation than in the same phase relation. Accordingly, the opposite phase relation is preferred for the user suffering from the knee pain when moving the foot supports along the V-shaped travel paths.

Figure 13:
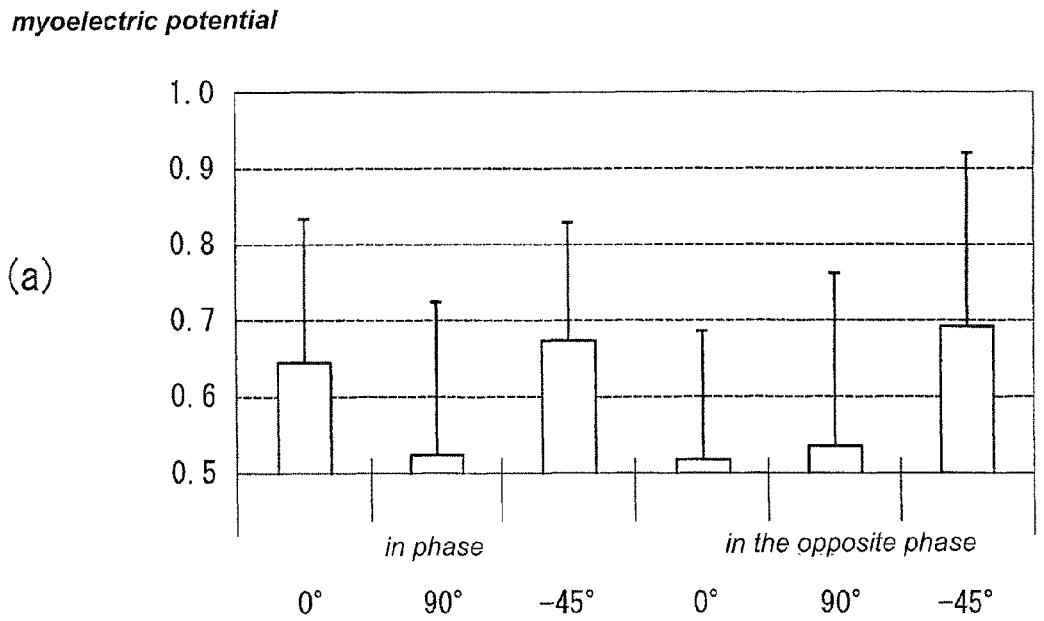
FIGS. 13(*a*) and 13(*b*) illustrate an effect of the above device.
Figure 13:
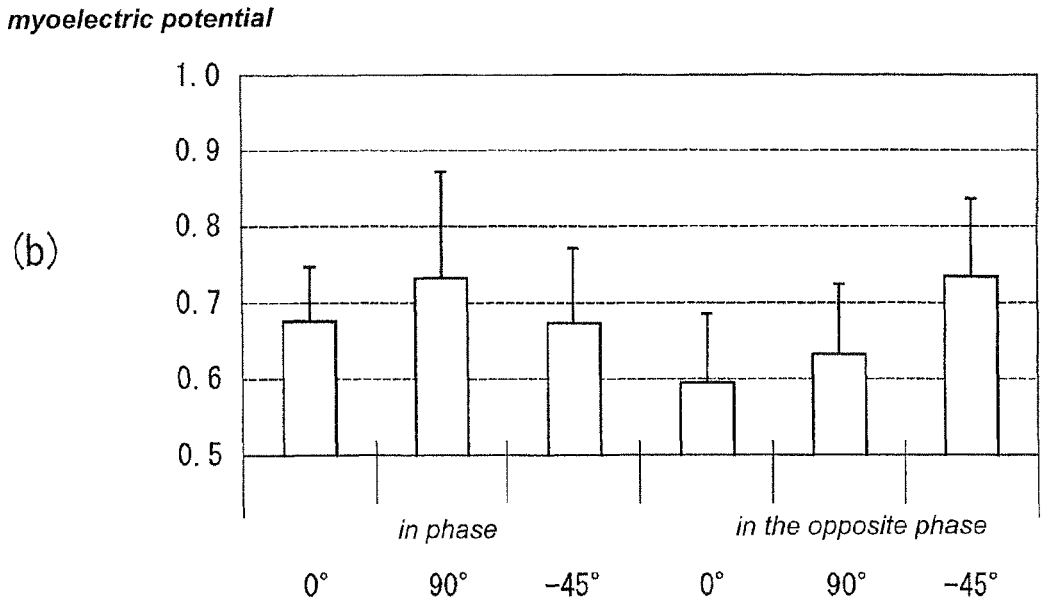

FIGS. 13(*a*) and (*b*) illustrate the muscle activity ratio varying with the angle and the phase. FIG. 13(*a*) illustrates the muscle activity ratio with regard to the flexor/extensor muscle groups relating the forward/backward movement, while FIG. 13(*b*) illustrates the muscle activity ratio with regard to the adductor/abductor muscle groups relating to left-and-right movement. In each figure, three bars on the left-half are the results of moving the left and right foot supports 2*a* and 2*b* in the same phase relation, and three bars on the right-half are the result of moving the left and right foot supports 2*a* and 2*b* in the opposite phase relation. Also, the three bars (from left to right) in each half correspond to the angle of 0°, 90°, and −45°, respectively. The angle of −45° means that the foot supports move along the travel paths La and Lb arranged in the inverted V-shaped motion pattern. The muscle activity ratio is defined as a ratio of myoelectric potential measured when moving the foot supports at a frequency of 1 Hz (both the left and right foot supports reciprocate one-stroke per one minute) with a travel distance (amplitude) of 3 cm to the same measured when moving the foot supports at a frequency of 2 Hz with the same amplitude.

As is seen from the results of FIG. 13, the selection of angle of −45° enhances the muscle activity ratio for the flexor/extensor muscle groups as well as the adductor/abductor muscle groups irrespective of whether the foot supports move in the same or opposite phase relation. According to the result of FIG. 13, the muscle activity ratio for the adductor/abductor muscle groups sees no significant difference when differing from the angle of −45°. Accordingly, when selecting the travel paths La and Lb of the V-shaped motion pattern, it is expected to enhance the muscle activity ratio for the whole leg irrespective of whether the foot supports move in the same or opposite phase relation.

In the present embodiment, each of the left and right foot supports 2*a* and 2*b* is allowed to swing about the axis Ay passing through the representative point in the y-direction so as to vary its tilt angle with respect to the forward/rearward direction, as described in the above. That is, the foot plate 21 provided on each of the left and right foot supports 2*a* and 2*b* is allowed to swing about the axles 24 relative to the footrest cover 24, enabling to vary the height positions of the forward end as well as the rearward end of the foot plate 21. Thus, the height positions of the toe and the heel of the foot placed on the foot plate 21*c* an be varied for enabling the plantarflexion and dorsiflexion of the ankle joint. The tilt angle varies within an angle of 20° on each of the plantarflexion side and the dorsiflexion side wherein the plantarflexion and the dorsiflexion are expressed respectively the positive and negative tilt angle relative to a horizontal in which the sole of the foot has the tilt angle of 0°. Further, the tilt angle can be adjusted in 5-steps by 10° at each of the forward end position, the initial position, and the rearward end position of the foot support. That is, the tilt angle of −20°, −10°, 0°, 10°, and 20° can be given to the foot support at each of the forward end position, the initial position, and the rearward end position. When moving between the initial position and the forward end position or the rearward end position, the foot support is caused to tilt correspondingly at the intermediate tile angles.

Figure 14:
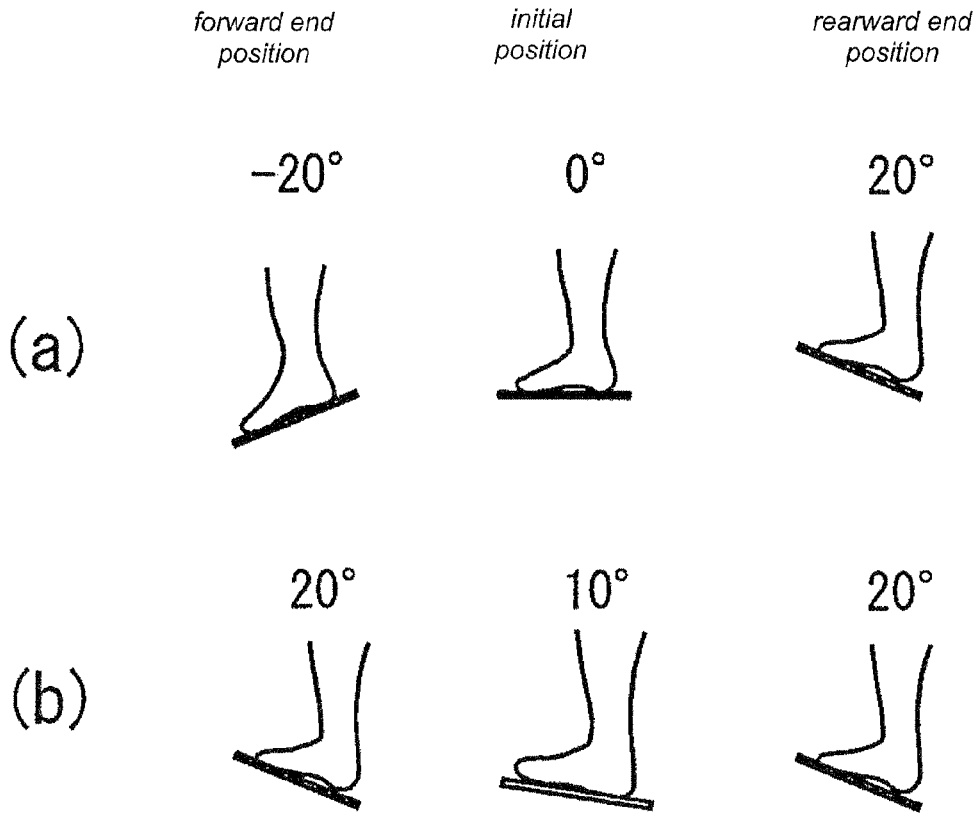
FIGS. 14(*a*) and 14(*b*) illustrate an effect of the above device.

FIG. 14 illustrates how the tilt angle is set. FIG. 14(*a*) illustrates one instance in which the tilt angles of −20°, 0°, and 20° are given respectively to the forward end position, the initial position, and the rearward end position of the foot support, while FIG. 14(*b*) illustrates another instance in which the tilt angles of 20°, 0°, and 20° are given respectively to the forward end position, the initial position, and the rearward end position of the foot support. In the instance of FIG. 14(*a*), the ankle joint undergoes the like angle change as in the walking to stretch the muscle groups relied upon in the walking, thereby realizing a passive walking exercise.

Especially, the flexion and the extension of the ankle joint brings about the stretching of the lower leg muscle groups, thereby promoting venous return and increase blood flow returning from the peripheral sites to the heart for enhancement of whole body blood circulation. Accordingly, it is expected to given an effect of relieving venous congestion beneficial for a user having a tendency of developing deep-vein thrombosis. In addition, with the flexion and the extension, the ankle joint can be expected to have a widened movable range. In the instance of FIG. 14(*b*), although the ankle joint undergoes a less angle range, the Achilles tendon can be stretched sufficiently to thereby enhance flexibility of the ankle joint and therefore widen the movable range thereof.

Further, when the each of the left and right foot supports 2*a* and 2*b* is arranged to vary its tilt angle in such a manner as to develop a counter-acting force which is aligned in the direction along the tibia, it is possible to reduce the shearing force acting on the knee, enable the use of the device even by the user suffering from knee pains.

Figure 15:
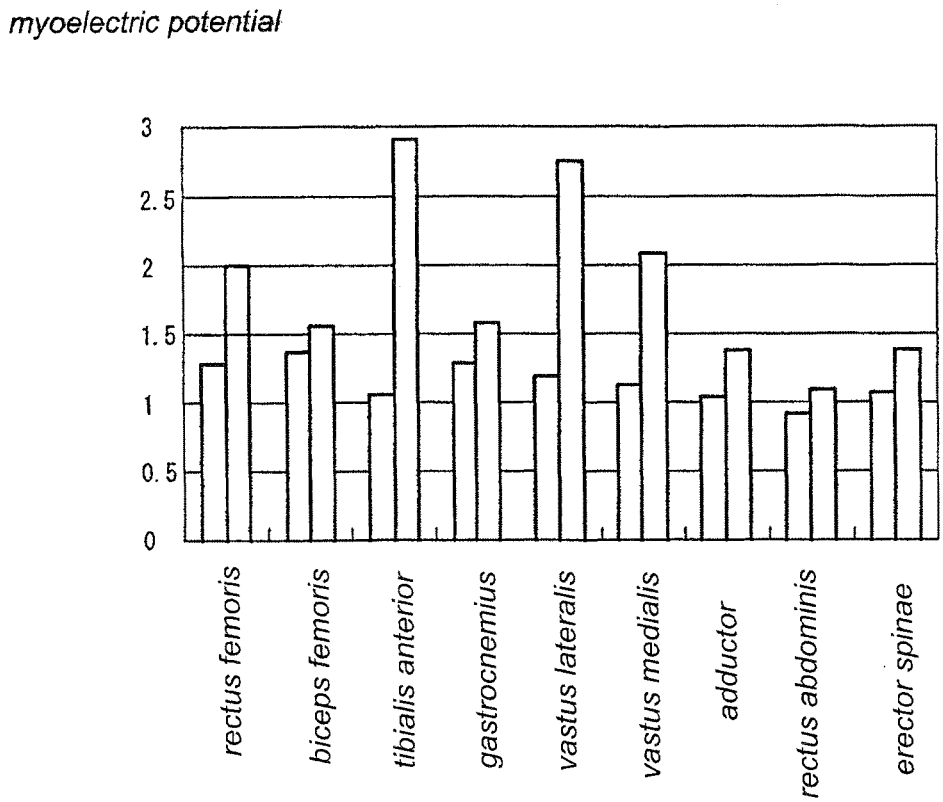
FIG. 15 illustrates an effect of the above device.

FIG. 15 illustrates a variation of myoelectric potential (integrated value) of the leg, wherein vertical axis represents the muscle activity ratio which is defined as a ratio of myoelectric potential of each muscle measured when the user is in exercise to that measured when the user is standstill on the device. For each of the muscles, left bar denotes the muscle activity ratio measured without varying the angle of the ankle joint, and left bar denotes the same measured with varying the angle of the ankle joint. When reciprocating the left and right foot supports 2*a* and 2*b* at a frequency of 1.6 Hz (also the angle of the ankle joint varies at 1.6 Hz), each of the anterior tibial muscle, the lateral vastus muscle, and the medial vastus muscle sees the myoelectric potential which is 2 to 3 times larger than when reciprocating the he foot supports without being accompanied with the angle change of the ankle, which demonstrates the effect of promoting the muscle activity of the whole leg.

In contrast to FIG. 14(*a*), when each of the left and right foot supports 2*a* and 2*b* varying the tilt angle is set to be 20° and −20° respectively at the forward end position and the rearward end position and is caused to vary the tilt angle in such a manner as to tilted rearwards to a greater extent as the foot support moves to the forward end position and tilted forward to a greater extent as the foot support moves to the rearward end position, the user's weight center can be less prone to move in the forward/rearward direction, which enables the user of less balancing capability to keep balancing.

In the above operation, each of the left and right foot supports 2*a* and 2*b* is explained to vary the tilt angle about the axis Ay parallel to the y-direction of the support coordinate system as it moves within the X-Y plane of the frame coordinate system. However, it is possible to keep the tilt angle at a constant while the foot support moves within the X-Y plane, provided that the tile angle is made adjustable. In this instance, the drive unit 3 can be dispensed with a mechanism of varying the tilt angle with the reciprocating movement of the foot support. When the tilt angle is fixed to an angle of stretching the Achilles tendon, it is expected to enhance flexibility of the gastrocnemuis and soles muscles.

When the drive unit 3 is configured to include two driving sources respectively for moving the left and right foot supports 2*a* and 2*b* in the forward/rearward direction, two driving sources respectively for moving these supports in the lateral direction, and two driving sources respectively for swinging the supports each about the axis Ay parallel to the y-direction in order to achieve the above mentioned operation, a control unit composed of a microcomputer can be used to control an interlocking movement of these driving sources. When the left and right foot supports 2*a* and 2*b* is drive to move in the forward/rearward direction as well as in the lateral direction in the opposite phase relation to each other, it is possible to use only two drive sources respectively for moving the left and right foot supports 2*a* and 2*b* in the forward/rearward direction as well as the lateral direction in combination with a transmission mechanism for realizing the opposite phase relation. When it is desired to achieve either one of the V-shaped motion pattern and the inverted V-shaped motion pattern, a single driving source is sufficient for achieving the motion pattern in combination with the transmission mechanism, since the movements in the forward/rearward direction and the lateral direction can be uniquely interlocked with each other.

When establishing the opposite phase (symmetrical) relation with respect to the tilt angles of the left and right foot supports 2*a* and 2*b* about the axis Ay parallel to the y-direction, a single driving source is sufficient. Further, when there is no requirement of individually setting the tilt angles at the forward end position, the rearward end position, and the initial position, the single driving source can be shared for moving the foot supports in the forward/rearward direction as well as in the lateral direction.

Figure 16:
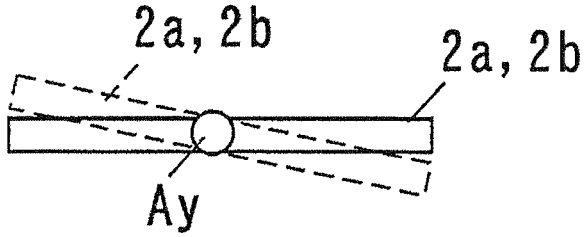
FIGS. 16(*a*) and 16(*b*) show an operation of the above device and positions of axis in the device, respectively.
Figure 16:
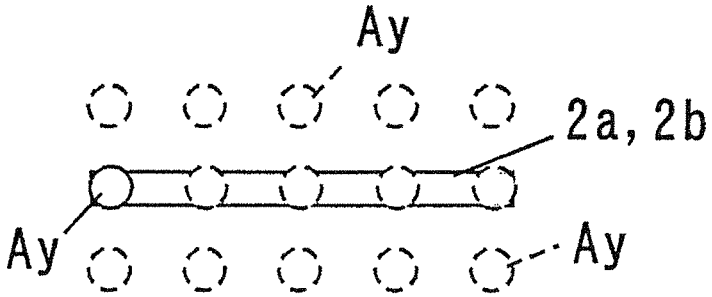

In order to vary the tilt angle about the axis Ay parallel to the y-direction for each of the left and right foot supports 2*a* and 2*b*, it is possible to set a pivot center at a suitable location inside or outside of each of the left and right foot supports 2*a* and 2*b*. The pivot center can be set at the center of each of the left and right foot supports 2*a* and 2*b* with respect to the forward/rearward direction (X-direction), or at any one of point indicated by circular dots in FIG. 16.

When the pivot center is set at the lengthwise center of the foot support, the each of the left and right foot supports 2*a* and 2*b* can be tilted against a load by a force half of that is required when the pivot center is set at the forward or rearward end of the foot support. Accordingly, this arrangement enables the use of a low-powered driving source when implementing the transmission mechanism with an output of applying the swinging or rotating force to the pivot center. While, on the other hand, when it is required to implement a power transmission mechanism of applying an output force to a portion other than the pivot center, the output power can be reduced as the point of force application is spaced further from the pivot center, i.e., by taking an advantage of leverage theory, thereby also enabling the use of a low-powered driving source even when the pivot center is set at either of the forward end or rearward end of the foot support.

When the pivot center is located outside of each of the left and right foot supports 2*a* and 2*b*, the tilt angle of the support varies in a non-linear relation with the varying position of the support in the X-Y plane. Accordingly, it is possible to differentiate a varying rate of the tilt angle around the forward end position or the rearward end position than around the initial position. The resulting operation is advantageous for affording easily balanced exercise and/or a rhythmical non-monotonic swinging movement about the ankle.

The foot support may be configured to swing freely about the axis Ay parallel to the y-direction without receiving from the rotational force from the drive source 3. In such instance, means is provided to restrict the swinging range for each of the left and right foot supports 2*a* and 2*b*, and to make the swinging range adjustable in order to realize the operation of tilting the user backward at the forward end position and titling forward at the rearward end position, without relying upon the swinging driving force from the drive unit 3.

When placing the feet on the device without being notified of a particular instruction, the user may attempt to align the longitudinal center of each foot with the longitudinal center line of each of the openings 11*a* and 11*b* rather than the moving direction of each of the left and right foot supports 2*a* and 2*b* (lengthwise direction of the rail 17). Taking this into consideration, the axis Ay is oriented to make an intended swinging movement thereabout. However, in view of that that use dose not always orient one's foot in correct direction, a positioning means 26 is provided on each of the left and right foot supports 2*a* and 2*b* to notify the correctly oriented position. The positioning means 26 may take the form of various configurations and include a marking recorded at the correctly oriented position as a simple one.

Figure 17:
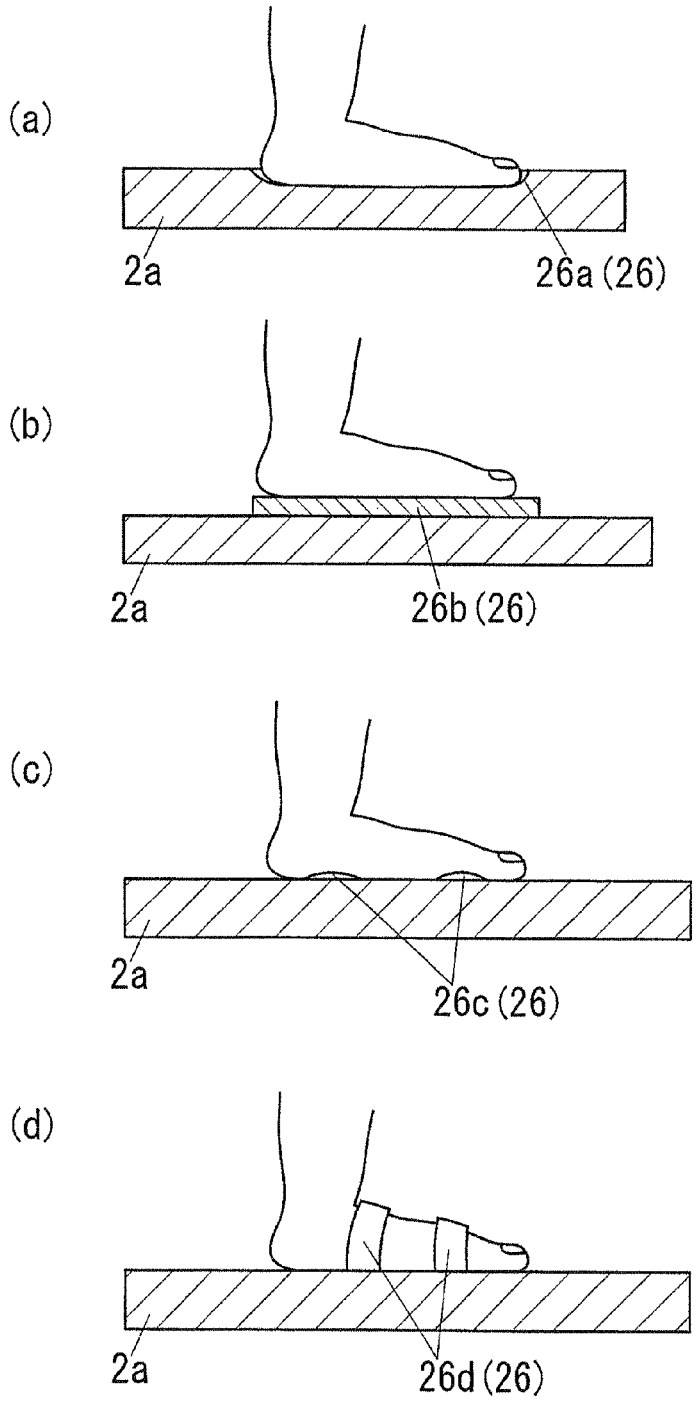
FIGS. 17(*a*) to 17(*d*) are sectional views respectively showing positioning members employable in the above device.

Further, the positioning means 26 may be in the form of a recess 26*a* in the upper face of each of the left and right foot supports 2*a* and 2*b*, as shown in FIG. 17(*a*), or in the form of a lug 26*b* on the upper face of each of the left and right foot supports 2*a* and 2*b*, as shown in FIG. 17(*b*). The lug 26*b* is preferred to be located to a position corresponding at least to one of the lengthwise ends of the foot. When it is located also corresponding to the arch of the foot, it is expected to give a massaging effect of stimulating the arch. The arrangements shown in FIGS. 17(*a*) and (*b*) do not fix the user's feet to the left and right foot supports 2*a* and 2*b*, respectively, it may occur that the foot is slipped out of the corresponding one of the left and right foot supports 2*a* and 2*b* when the support is tilted at a large angle.

In view of this, each of the left and right foot supports 2*a* and 2*b* may is provided with an anti-skid member 26*c* formed from a material such as a rubber having a high coefficient of friction (or shaped to have minute surface irregularities) as the positioning means 26. The anti-skid member 26*c* may be adhered on or embedded in the upper surface of each of the left and right foot supports 2*a* and 2*b*. Further, the anti-skid member 26*c* may be shaped into a plate or into a configuration conforming to the contour of the bottom of the foot. Still further, the anti-skid member 26*c* may be combined with the recess 26*a* of FIG. 17(*a*) or the lug 26*b* of FIG. 17(*b*) for enhancing the positioning effect.

FIG. 17(*d*) illustrates the positioning means 26 in the form of belts 26*d* adapted to be wrapped around the foot instep and including front and rear ones. The foot inserted behind the belts is thus fixed to the foot support. The belts 26 may be provided with hook-and-loop fastener or buckle for adjustment depending upon the foot size.

The individual features shown in FIG. 17 can be suitable combined. For example, the combination of the features shown in FIGS. 17(*a*), (*b*), (*c*), and (*d*) can successfully prevent the foot slipping or skidding. When the device is utilized by the user with the shoe, the foot step may be provided with a toe clip or binding as is common to a pedal of bicycle for fixing the user's foot.

The left and right foot supports 2*a* and 2*b* may be also configured to adjust the foot position relative to the foot support. In this instance, the adjustment can be made to vary a distance from the pivot center to the foot in order to give a light-load and easily balanced exercise accompanied with less stretching amount of the muscle groups when the foot is placed near to the pivot center, and a heavy-load exercise necessitating to shift the user's weight center to a greater extent accompanied with more stretching amount of the muscle groups when the foot is placed further away from the pivot center.

Now, an explanation is made to a structure of swinging each of the left and right foot supports 2*a* and 2*b* about the axis Ay parallel to the y-direction. In order to link the swinging movement of the foot plate 21 about the axle 24 with the reciprocating movement thereof along the rail 17, the base plate 18*a* is provided at a portion along the travel path of the foot plate 21 with a guide surface 14 including an inclination 14*a*. In this connection, the foot plate 21 is provided on its bottom with a follower projection 25 which comes into engagement with the guide surface 14. In the illustrated embodiment, the inclination 14*a* extends the full length of the guide surface 14 at a constant angle relative to the upper face of the base plate 1*a*. The guide surface 14 is not particularly delimited to the illustrated embodiment and may be shaped to have the inclination partially along its length. Although it is suffice that the follower projection 25 is formed from a material and/or shaped into a configuration to have a tip of small coefficient of friction, the follower projection 25 is preferred to have at its top a roller 25 which comes into rolling contact with the guide surface 14, as illustrated in the figure.

The follower projection 25, which is arranged to come into rolling contact with the guide surface 14, rides up and down the inclination 14*a* while each of the left and right foot supports 24*a* is driven by the motor 31 to reciprocates, thereby swinging the foot plate 21 about the axle 24 to vary its tilt angle relative to the base plate 1*a*, and therefore enabling the plantarflexion and dorsiflexion at the ankle joint.

Figure 19:
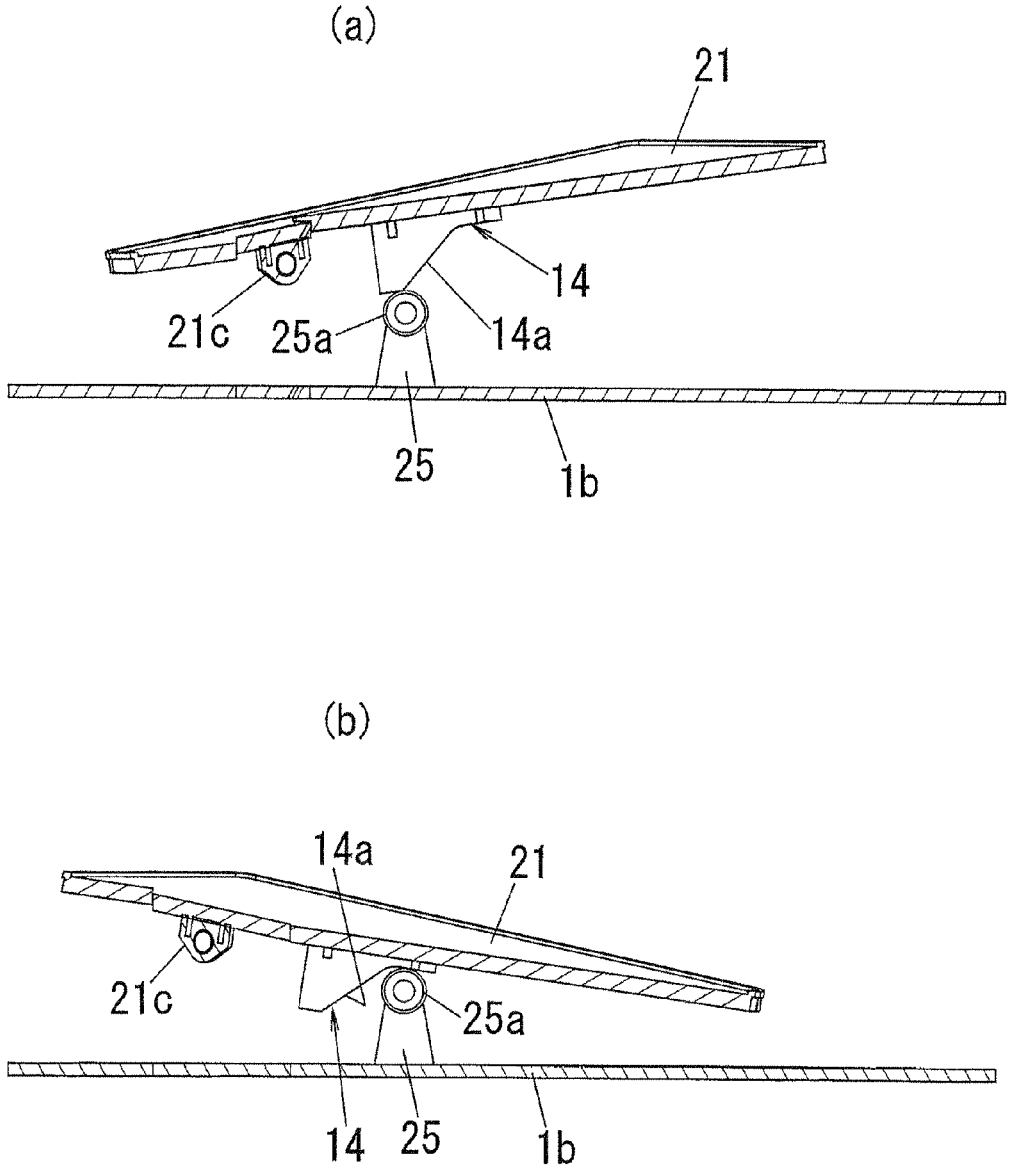
FIGS. 19(*a*) and 19(*b*) are explanatory views showing an operation of the device of another configuration.

Although the illustrated embodiment has the base plate 1*a* formed with the guide surface 14*a* and the foot plate 21 formed with the follower projection 25, the same operation can be achieved with a configuration of FIG. 19 in which the foot plate 21 is provided with the guide surface 14 and the base plate 1*a* is provided with the follower projection 25.

In the above embodiment, the router 32 of the drive unit 3 is configured to have the worm 32*a* and the worm wheels 32*b* for realizing the power transmission from the output shaft 31*a* of the motor 31 to the rotary shaft 35 of the worm wheel 32*b* with speed reduction. However, a belt can be utilized to transmit the power from the output shaft 31*a* of the motor 31 to the rotary shaft 35 perpendicular to the output shaft 31*a*. In this instance, instead of the worm wheel 32*b*, a pulley is utilized to receive the belt while dispensing with the worm 32*a*.

In the above embodiment, the motor 31 has its output shaft 31 extending along the upper surface of the base plate 1*a*. However, when the output shaft 31*a* is required to extend perpendicular to the upper surface of the base plate 1*a*, spur gearing is adopted to achieve the transmission and routing of the rotary power, instead the combination of the worm 32*a* and the worm wheels 32*b*. In this instance, pulleys and a belt may be used in place of the spur gearing for transmission of the rotary power between the pulleys.

Instead of using the crank plate 36 and the crank rod 38, the reciprocator 33 may be composed of a grooved cam driven to rotate by the motor 31 and a cam follower engaged in a groove of the cam. In this instance, the grooved cam can be used instead of the worm wheel 32*b* and be arranged to have its rotation axis parallel to the output shaft 31*a* of the motor for power transmission from the output shaft 31*a* to the grooved cam through a pinion.

Further, when using only one grooved cam for power transmission from the output shaft 31*a* of the motor 31 to the groove cam, two cam followers can be used for engagement respectively with the cam grooves of the cams such that the grooved cam and the cam followers are cooperative to function as the router 32 as well as the reciprocators 33.

As apparent from the above, the drive unit 3 can drive the left and right foot supports 2*a* and 2*b* to move in the forward/rearward direction and at the same time to move in the lateral direction in the linked manner to each other. The left and right foot supports 2*a* and 2*b* are driven to reciprocate linearly along the rails 17, respectively, so as to move in directions different from the lengthwise directions of the feet. For example, the left and right foot supports 2*a* and 2*b* move in the directions inclined at an angle of 45° relative to the forward/rearward direction of the housing 1, over the travel distance of 20 mm, for example.

Also as discussed in the above, the foot plate 21 is driven to swing about the axle 24 as each of the left and right foot supports 2*a* and 2*b* reciprocates along the rail 17. While the foot plate 21 is moving, the follower projection 25 rides up and down the inclination 14*a* of the guide surface 14 to cause the dorsiflexion of the ankle joint when each of the left and right foot supports 2*a* and 2*b* comes to its forward end position, and the plantarflexion when it comes to its rearward end position. The axle 24 is positioned nearer to the heel within the length of the foot bottom. Each of the dorsiflexion and plantarflexion is realized at the tilt angle of about 10° relative to a reference plane defined by the upper surface of the base plate 1*a*.

The dorsiflextion and the plantarflexion can be made respectively at the rearward end position and the forward end position of each of the left and right foot supports 2*a* and 2*b* in opposite relation to the above. Also, the tilt angle relative to the reference plane can be selected differently from the above mentioned angle. Such modified operation can be easily realized by an appropriate shaped guide surface 14.

As described in the above, the left and right foot supports 2*a* and 2*b* are arranged such that one of them comes to its forward end position when the other comes to its rearward end position with accompanied shifting of the position in the lateral direction. This movement causes the trunk of the user's body to twist for stimulating the viscera. However, in view of that the upper body of the user is left freely to twist, some user may make a counter-movement for keeping ones' body free from being twisted.

In order to avoid this counter-movement, the device may rely on a handrail which the user holds on for fixing the upper body. The handrail may be formed as in integral part of the housing 1 or may be placed in a location in premises where the device is utilized. The handrail can support the user and makes the device easily available by the user with less balancing capability. Further, the device is mainly designed for use by the user in the standing posture, but can be designed to include a seat to so as to be readily available for the user in the sitting posture for the purpose of rehabilitation exercise by the user who is difficult to keep standing.

Second Embodiment

In contrast to the first embodiment in which the left and right foot supports 2*a* and 2*b* move in the opposite phase relation for keeping the user's weight center free from shifting in the forward/rearward direction, the shifting of the user's weight center in that direction will cause a reflex nerve system of the user to keep the body from falling forwards or rearwards, thereby stimulating the muscle groups (e.g., latissimus dorsi muscle, greater psoas muscle, and iliopsoas muscle) working to maintain the body from falling.

For this purpose, the present embodiment is configured to move the left and right foot supports 2*a* and 2*b* with a phase relation other than the 180° phase difference relation. The phase relation may be a 0° phase difference such that the left and right foot supports 2*a* and 2*b* moves together in the forward/rearward direction. When the phase difference is other than 180°, an acceleration force applies to the body at either of the forward end position or the rearward end position of the support to shift the user's weight center in the forward/rearward direction, thereby stimulating the muscle groups that work to keep the user's body from falling. Further, when such movement is combined with the movement of varying the tilting angle of each of the left and right foot supports 2*a* and 2*b*, the user is more difficult to maintain one's weight center to thereby strengthen the muscle groups working to keep the body from falling. The other configurations and operations are identical to those of the first embodiment.

Third Embodiment

Figure 20:
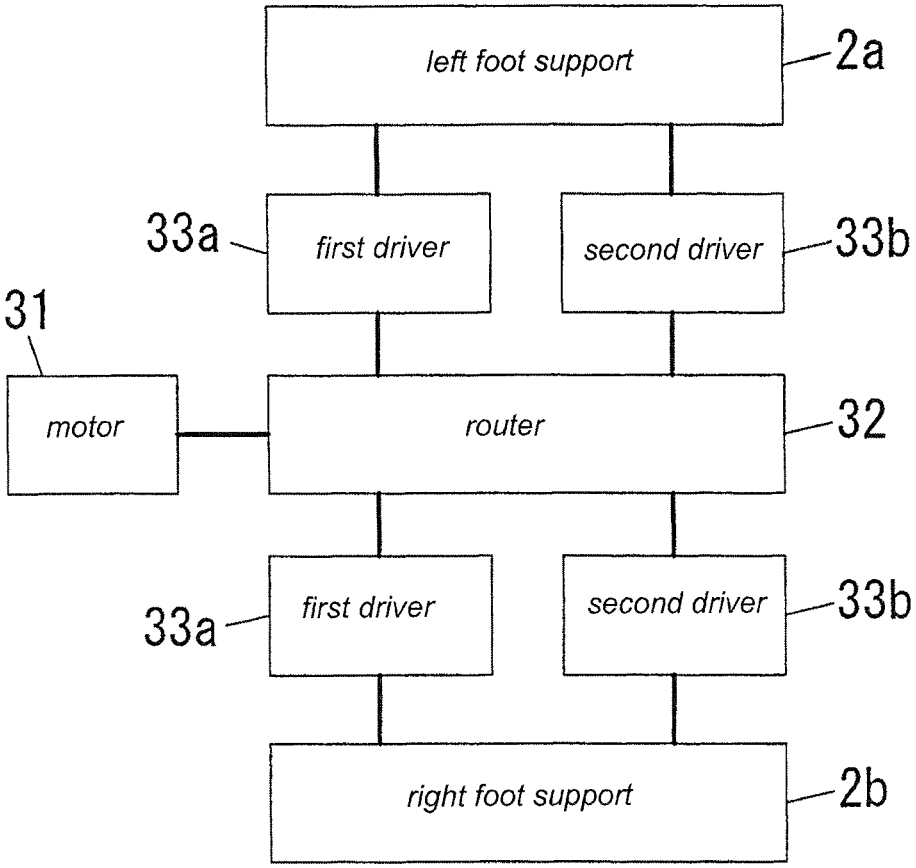
FIG. 20 is a system diagram showing a drive unit employed in a passive exercise assisting device in accordance with a third embodiment of the present invention.
Figure 21:
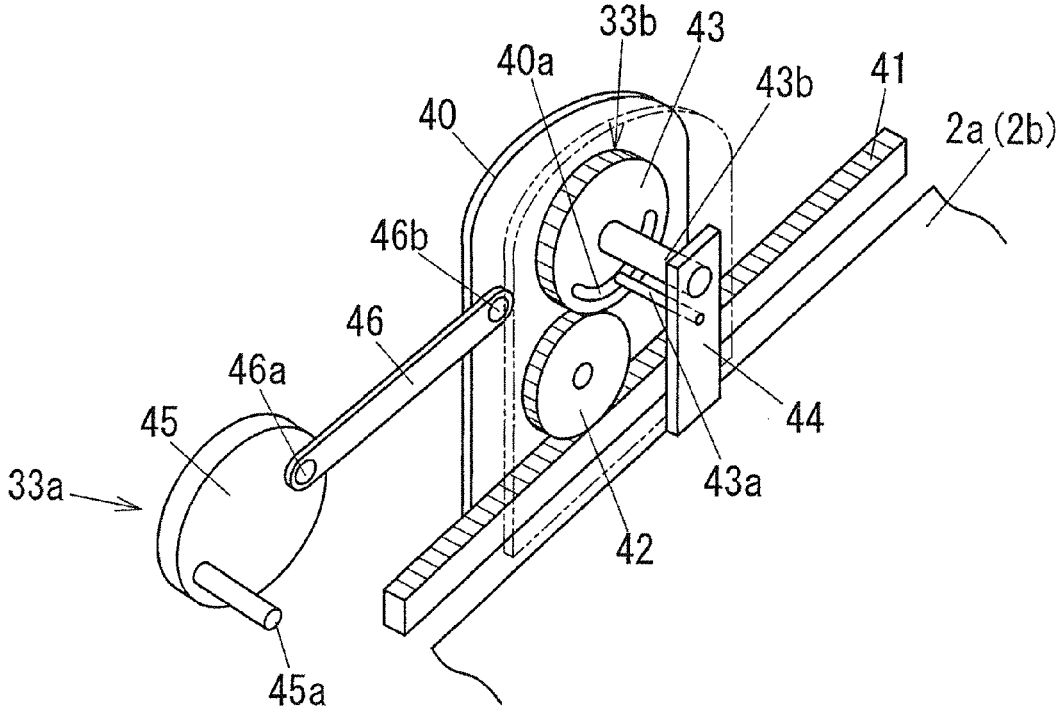
FIG. 21 is a perspective view showing a principal part of the above drive unit.

In contrast to the first embodiment in which the follower projection 25 is provided on the lower surface of the foot plate 21 and follows the guide surface 14 on the base plate 1*a* so as to vary the tilt angle of each of the left and right foot supports 2*a* and 2*b* about the axle 24 parallel to the y-direction, the present embodiment is configured, as shown in FIG. 20, to include first drivers 33*a* respectively configured to receive the driving force through the router 32 and move the representative points of the left and right foot supports 2*a* and 2*b* in a sliding relation to the upper surface of the base plate 1*a*, and second drivers 33*b* respectively configured to receive the driving force through the router 32 and vary the tilt angles of the left and right foot supports 2*a* and 2*b* about the individual axes Ay parallel to they-direction. The first and second drivers 33*a* and 33*b* are configured as shown in FIG. 21. Although the illustrated configuration omits the transmission paths from the worm wheels 32*b* to the first and second drivers 33*a* and 33*b*, the transmission paths can be realized by use of known transmission elements such as gears or belts to transmit the driving force.

The second driver 33*b* is introduced to vary the tilt angle of the corresponding one of the left and right foot supports 2*a* and 2*b* for varying the angle of ankle joint. To this end, the second driver is configured to vary the tilt angle of each of the left and right foot supports 2*a* and 2*b* within a plane (hereinafter referred to as "swinging plane") parallel to an extension line passing through the ankle joint.

FIG. 21 illustrates a structure which varies the tilt angle of the upper face of each of the left and right foot supports 2*a* and 2*b* in such a manner that the foot support traces a downwardly curved travel path when it moves in the forward/rearward direction. In the illustrated embodiment, each of the left and right foot supports 2*a* and 2*b* is caused to vary its tilt angle such that the heel is lowered than the toe when the foot support comes to its forward end position of the travel path, and the toe is lowered than the heel when it comes to its rearward end position of the travel path.

The first driver 33*a* includes an eccentric rotor 45 receiving the rotation force from the router 32, and a crank rod 46 having its one end connected to the eccentric rotor 45 by means of a crank pin 46*a*, and the other end rotatably coupled to a gearbox 40 through a crank journal 46*b*. The gearbox 40 has its linear moving path restricted along the length of a rack 41, as shown in FIG. 21. Thus, rotation of the eccentric rotor 45 varies a distance from its rotation center 45*a* to the coupling end of the crank rod 46 to the gearbox 40, causing the gearbox 40 to move linearly along the length of the rack 41.

The gearbox 40 bears two intermeshed spur gears 42 and 43 having a different number of teeth. The spur gear 42 with less number of teeth meshes with the rack 44. Accordingly, while the gearbox 40 slides along the rack 41 upon rotation of the eccentric rotor 45, the spur gear 42 is caused to rotate and drive the spur gear 43 to rotate. Within one rotation of the eccentric rotor 45, the spur gear 42 reciprocates one cycle on the rack 41 so as to drive the spur gear 43 to rotate in a reciprocating fashion within an angle of about ±30° relative to the horizontal The left and right foot supports 2*a* and 2*b*, each coupled to the corresponding one of the spur gears, to vary its tilt angel as the spur gear 43 rotates back and forth. Since the gearbox 40 moves linearly along the rack 41, the left and right foot supports 2*a* and 2*b* are each driven to move linearly along the rack 41. That is, the length of the rack 41 defines the direction along with the corresponding one of the left and right foot supports 2*a* and 2*b* moves.

As will be clear from the above explanation, the gearbox 40 and the rack 41 constitute a part of the first driver 33*a*, while the rack 41 is cooperative with the spur gears 42 and 43 to constitute the second driver 33*b*. In the present embodiment, therefore, the first driver 33*a* transmits the driving force to the second driver 33*b*, while the driving forces from the first driver 33*a* and the second driver 33*b* are transmitted to the corresponding one of the left and right foot supports 2*a* and 2*b* through the second driver 33*b*.

In the illustrated embodiment, the gearbox 40 has an arcuate guide slit 40*a* through which a coupling shaft 43*a* of the spur gear 43 extends. The spur gear 43 has its rotor shaft 43*b* coupled together with the coupling shaft 43*a* to a swing plate 44 which is, in turn, connected to the corresponding one of the left and right foot supports 2*a* and 2*b*. That is, each of the left and right foot supports 2*a* and 2*b* swings about the axis defined by the rotor shaft 43*b*.

As apparent from the above, the rotor shaft 43*b* is located above the upper surface of the corresponding one of the left and right foot supports 2*a* and 2*b*. In particular, the rotor shaft 43*b* is set at such a location where an extension line of the rotor shaft 43*b* extends through the ankle joint when the foot is placed at a position designated with the help of the above-mentioned positioning means 26. However, since there are differences among individual user's foot size, the positioning means 26 may be configured to be available irrespective of the foot size, such as the anti-skid member 26*c* or binding, or may be configured to be adjustable stepwise in match with the foot size. The rotor shaft 43*b* is spaced from the upper surface of the corresponding one of the left and right foot supports 2*a* and 2*b* by a distance determined in consideration of an average foot size of the intended users. In addition, it is possible to detachably stack one of adjustor plates of different thickness on each of the left and right foot supports 2*a* and 2*b*, or even to provide an adjustor mechanism for varying the positions where the coupling shaft 43*a* and the rotor shaft 43*b* are coupled to the swing plate 44.

Figure 22:
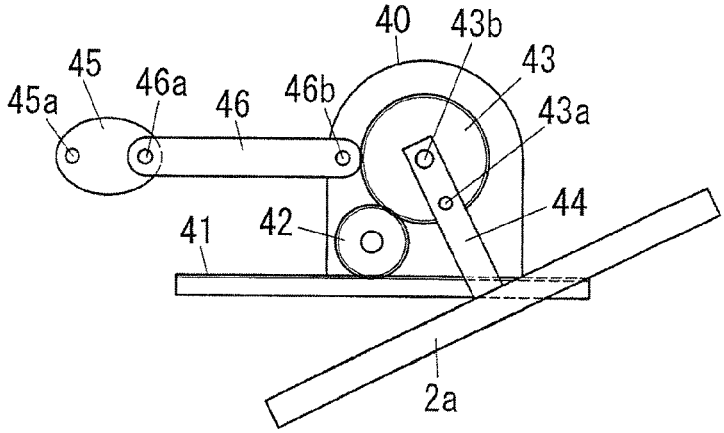
FIGS. 22(*a*) to 22(*c*) are explanatory views showing an operation of the above drive unit.
Figure 22:
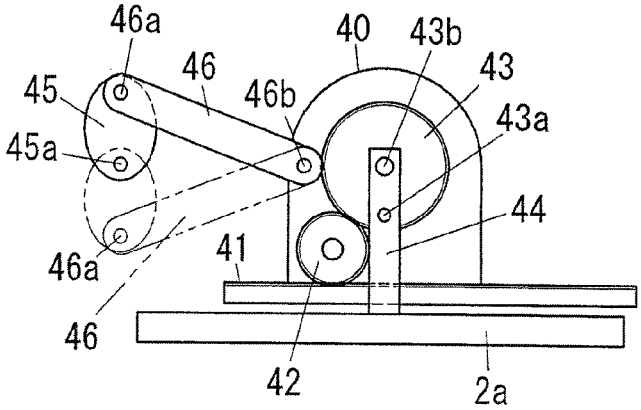
Figure 22:
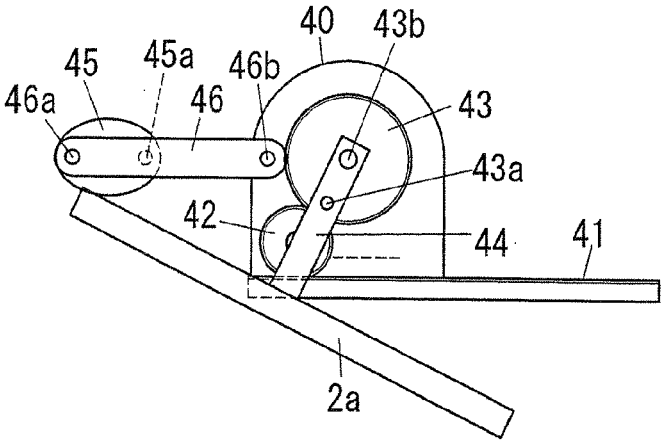

The operation derived from the structure of FIG. 21 is summarized in FIG. 22. In one operation of FIG. 22, each of the left and right foot supports 2*a* and 2*b* can be adjusted to have its upper surface inclined at a suitable angle. For example, one or both of the left and right foot supports 2*a* and 2*b* has its upper surface lying horizontally when the crank pin 46*a* comes in registration with either of the upper and lower position of the rotation center 45*a* of the eccentric rotor 45, as shown in FIG. 22(*b*).

Assuming that the right-hand side in FIG. 22 denotes the forward direction, when the crank pin 46*a* is located forwardly of the rotation center 45*a* of the eccentric rotor 45, the coupling shaft 43*a* takes a position forwardly of the rotor shaft 43*b*, as shown in FIG. 22(*a*), the corresponding one of the left and right foot supports 2*a* and 2*b* is inclined to have its front end located above its rear end, which means that the heel is lowered than the toe. While on the other hand, when the crank pin 46*a* is located behind the rotation center 45*a* of the eccentric rotor 45, the coupling shaft 43*a* takes a position behind the rotor shaft 43*b*, as shown in FIG. 22(*c*), the corresponding one of the left and right foot supports 2*a* and 2*b* is inclined to have its rear end located above its front end, which means that the toe is lowered than the heel.

Through the above operation, the foot position undergoes a sliding movement to stretch the leg muscle groups of the user in one hand, and the ankle joint undergoes variably angled movement to stimulate the lower leg muscle groups on the other hand. Thus, the movement simulating the walking is given to stimulate the muscle groups of the femoral region as well as the lower leg, which makes the device available for the walking exercise as in rehabilitation. Further, since the foot position sees only the sliding movement without requiring the user to lift the femoral portions, the device is also available to the user who is difficult to keep balancing due to knee joint pains or lowered femoral muscular strength. Further, the stretching of the lower leg muscle groups will relax muscle groups around the ankle joints to prevent the narrowing of the movable range thereof and to stretch the gastrocnemius muscles for promotion of venous return.

In the above operation, since the toe is raised to a higher level than the heel as the corresponding one of the left and right foot supports 2*a* and 2*b* slides to its front end position within the movable range, and the heel is raised to a higher level than the toe as the corresponding foot support slides to its rearward end of the movable range, the operation can simulate a natural walking and therefore is available for walk training. However, the angle change about the rotor shaft 43*b* may be done in the direction opposite to that of the above operation. That is, different operation may be given in which the heel is raised to a higher level than the tow as the corresponding one of the left and right foot supports 2*a* and 2*b* slides to its front end position within the movable range, and the toe is raised to a higher level than the heel as the corresponding foot support slides to its rearward end of the movable range. In contrast to the former operation where the ankle joint undergoes less angle change, the latter operation enables the ankle joint to undergo the angle change over a wider range, effective for training of enlarging the movable range of the ankle joint. Especially, the ankle joint sees the dorsiflexion when the foot support comes to its rearward end position, thereby enhancing an effect of stretching the Achilles tendon.

As seen in the above illustrated embodiment, the rotor shaft 43*b*, which defines the rotation center about which the corresponding one of the left and right foot supports 2*a* and 2*b* swings, has its extension line passing through the ankle joint of the user, such that the ankle joint sees no substantial vertical movement during the corresponding one of the left and right foot supports 2*a* and 2*b* is swinging about the rotor shaft 43*b*. Thus, the ankle joint is relatively free from the load resulting from the vertical movement. In other words, the user sees only less load acting on the ankle joint as well as less shifting amount of the weight center, and therefore is easy to keep balancing. When adopting the above structure in which the extension line of the rotor shaft 43*b* passes through the ankle joint, it is required to locate the rotor shaft 43*b* above the corresponding one of the left and right foot supports 2*a* and 2*b*, which necessitates a large vertical space above the base plate 1*a*.

In order to reduce the vertical space above the base plate 1*a*, it is preferred to dispose the pivot axis or the rotor shaft on the bottom side of each of the left and right foot supports 2*a* and 2*b*. For example, the rotor shaft may be disposed at a portion immediately below the ankle joint and configured to be driven by the second driver 33*b* to rotate, while the second driver 33*b* is driven by the first driver 33*a* to make the sliding movement for saving the vertical space.

When adopting this configuration, although the ankle joint undergoes some vertical displacement as the corresponding one of the left and right foot supports 2*a* and 2*b* makes the sliding movement, the ankle joint is spaced from the rotor shaft by a minimum distance while satisfying a condition of disposing the rotor shaft below the foot support, since the rotor shaft is disposed immediately below the ankle joint. In addition, it is also possible to combine the first and second drivers 33*a* and 33*b* into a compact arrangement. For example, the first drivers 33*a* are used for giving the slide movement to the corresponding one of the left and right foot supports 2*a* and 2*b*, and a guide which constitutes the second driver 33*b* responsible for varying the tilt angle of the corresponding one of the left and right supports 2*a* and 2*b* about the rotor shaft provided as the pivot axis on the corresponding one of the left and right foot supports 2*a* and 2*b* (the guide may be configure to have a guide bar and a cam groove as discussed in the embodiment hereinafter described).

The rotor shaft may be disposed at a position not immediately below the ankle joint but further away therefrom so as to increase the vertical displacement amount of the ankle joint, making the device effective for training balancing function of the user.

The above instance illustrates that the rotor shaft 43*b* is oriented to have its axial direction perpendicular to the direction in which the representative point of the corresponding one of the left and right foot supports 2*a* and 2*b* makes the sliding movement. When it is required to cross these direction an angle other than the right angle, skew worm gears or bevel gears may be used instead of the spur gears 42 and 43.

It is equally possible to use a universal hook joint for driving connection between the first driver 33*a* and the second driver 33*b* at a desired angle. When using the universal hook joint, the left foot support 2*a* is integrated with the first and second drivers 33*a* and 33*b* into one block, while the right foot support 2*b* is integrated with the first and second drivers 33*a* and 33*b* into another block. Then, the two blocks are individually made adjustable to determine the angle at which the direction of the sliding movement of the representative point of each of the left and right foot supports 2*a* and 2*b* is inclined relative to the forward/rearward direction of the base plate 1*a*.

For instance, each block is coupled at its rear end to the base plate 1*a* by means of a pivot pin so as to be capable of swinging within the horizontal plane, and is provided with a latch pin engageable selectively into one of holes spaced from the center of the block by a constant distance. Thus, it is possible to select one from a plurality of the sliding movement directions along each of which the corresponding one of the left and right foot supports 2*a* and 2*b* moves. In this instance, each of the left and right foot supports 2*a* and 2*b* undergoes the sliding movement linearly along the travel path. Thus, it is possible to adjust the angle of the travel path relative to the forward/rearward direction. In this sense, each block is cooperative with the pivot pin, the latch pin, and the holes to realize a moving direction determination mechanism.

Since the first and second drivers 33*a* and 33*b* are coupled to each other by means of the universal hook joint, each of the left and right foot supports 2*a* and 2*b* can have its sliding movement direction which is adjustable over a wide range, while the maintaining an angle of 5° to 15° at which the swinging plane perpendicular to the rotor shaft 43*b* is inclined relative to the forward/rearward direction of the base plate 1*a*. For instance, the sliding movement direction of each of the left and right foot supports 2*a* and 2*b* can have its sliding movement direction inclined relative to the forward/rearward direction of the base plate 1*a* at an angle of 5° to 45° (counterclockwise angle for the left foot support 2*a*, and clockwise angle for the right foot support 2*b*).

Although the above embodiment illustrates that the first and second drivers 33*a* and 33*b* are arranged to operate at the same cycle, they may be arranged to operate at differing cycles. When so arranged, the device gives an irregular movement different from the normal walking for enabling a training of sophisticate movement. The other configurations and operations are identical to those of the first embodiment.

Fourth Embodiment

Figure 23:
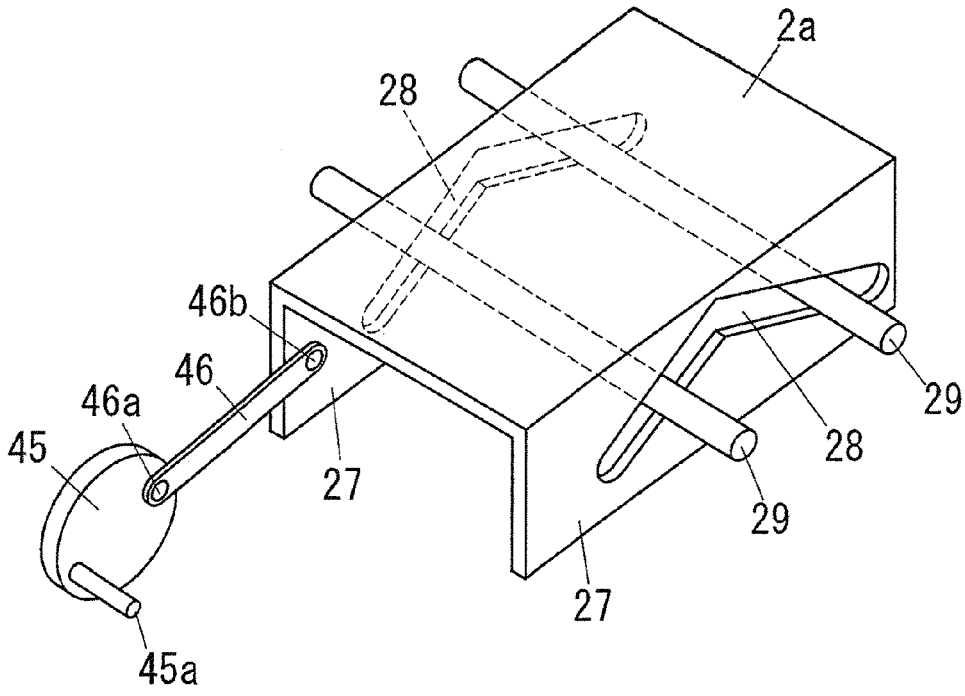
FIG. 23 is a perspective view showing a principal part of a passive exercise assisting device in accordance with a fourth embodiment of the present invention.

The present embodiment is basically identical to the third embodiment except for the configuration of the second driver 33*b*. As shown in FIG. 23, the second driver 33*b* includes a pair of side plates 27 depending from the opposite lateral sides of each of the left and right foot supports 2*a* and 2*b*, and two guide bars 29 which are fixed on the base plate 1*a* and extend through cam grooves 28 formed respectively in the side plates 27. The first driver 33*a* has the same configuration as in the third embodiment to have the eccentric rotor 45 receiving the rotation force from the router 32, and the crank rod 46 which has its one end coupled to the eccentric rotor 46 and has it's the other end coupled to the corresponding one of the left and right foot supports 2*a* and 2*b* by way of the crank journal 46*b*.

The cam groove 28 has an inverted V-shape with its opposite ends lowered than its center. The two guide bars 29 are provided to bear the load acting on the corresponding one of the left and right foot supports 2*a* and 2*b* by way of the crank journal 46*b*.

Figure 24:
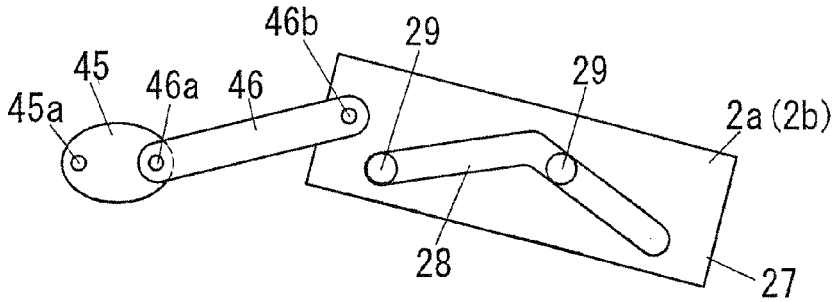
FIGS. 24(*a*) to 24(*c*) are explanatory views showing an operation of the above device.
Figure 24:
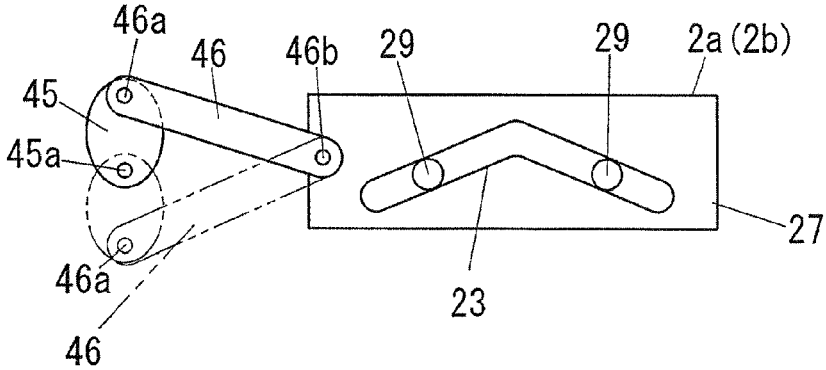
Figure 24:
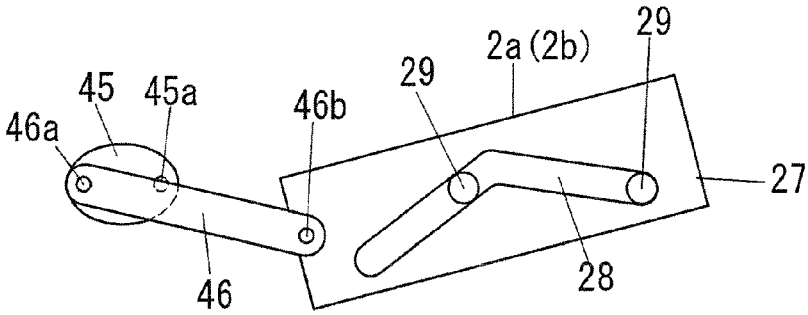

Since the cam groove 28 has its center higher than its opposite ends, while each of the left and right foot supports 2*a* and 2*b* is driven by the first driver to make the sliding movement, the upper surface of each foot support is varying its surface angle in such a manner that the tow is lowered than the heel when each foot support comes to its forward end position, and the heel is lowered than the toe when each foot support comes to its rearward end position, as shown in FIG. 24, As the contour of the cam groove 28 determines the manner of varying the surface angle of the left and right foot supports 2*a* and 2*b*, it is easy to give a suitable relation between the position along the sliding movement path and the vertical displacement for each of the left and right foot supports 2*a* and 2*b*. Further, the above configuration enables to swing each foot plate without requiring to drive the foot support about a dedicated axis, enhancing flexibility of designing various patterns of varying the angle of the ankle joint.

With the use of the oppositely shaped or V-shaped cam groove 28, the tow is raised higher than the heel when the corresponding one of the left and right foot supports 2*a* and 2*b* comes to the forward end position of its sliding movement range, and the heel is raised than the tow when it comes to the rearward end position of the sliding movement range. Although FIG. 23 shows the configuration by which the angle of the ankle joint varies in a pattern different from the walking with varying foot position along the forward/rearward direction, the cam groove 28 may be suitable shaped to bring about the same pattern of varying the angle of the ankle joint as seen in the walking. Further, it is possible to provide independent cam grooves 28 each associated with each of the guide bars 29 and extending in parallel with each other.

Although the illustrated embodiment has the cam grooves 28 each in the form of slot through which the guide bars 29 extend, each of the side plates 27 may be formed at its lower edge with the cam groove 28 in order to reduce its vertical dimension for realizing a low-profile structure of the base plate 1*a*.

Since the present embodiment is identical to the third embodiment except for the structure of the second driver 33*b*, no further explanation is deemed necessary for the identical structures.

Fifth Embodiment

Figure 25:
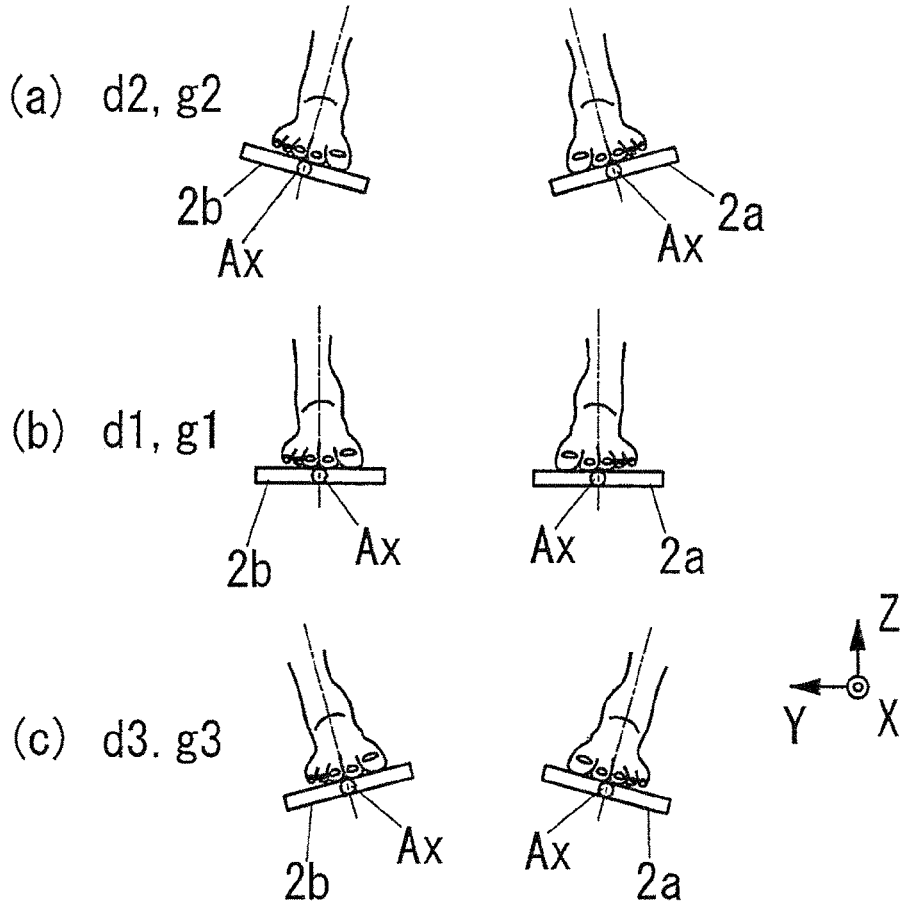
FIGS. 25(*a*) to 25(*c*) are explanatory views showing an operation of a passive exercise assisting device in accordance with a fifth embodiment of the present invention.

FIG. 25 illustrates the embodiment in which each of the left and right foot supports 2*a* and 2*b* is allowed swing about an axis Ax parallel to the x-direction, in contrast to the first embodiment in which the foot support is allowed to swing about the axis Ay parallel to the y-direction.

In the illustrated embodiment, the foot support is configured to tilt inward at its forward end position, as shown in FIG. 25(*a*), to lie horizontally at its initial position, as shown in FIG. 25(*b*), and to tilt outward at its rearward end position. In this way, the inwardly tilting and the outwardly tilting are repeated while the left and right foot supports 2*a* and 2*b* move in the forward/rearward direction as well as in the lateral direction, thereby developing an acceleration of bending the user's body sideward. In this consequence, a reflex occurs in the user to keep the body free from falling against the acceleration and therefore stimulate the side leg muscles, enabling to strengthen the muscle groups for curing bowlegged or knock-kneed legs.

Each of the left and right foot supports 2*a* and 2*b* is given its tilt angle which is suitably determined at each of its forward end position, initial position, and rearward end position in such a manner that the drive unit 3 vary the tilt angle continuously as the foot supports varies its position within the X-Y plane.

The pivot center about the axis Ax parallel to the x-direction may be set either at the center of each of the and right foot supports 2*a* and 2*b* with respect to the y-direction of the support coordinate system, or at a suitable location inside or outside of each foot support. The positional effect of the rotation center is same as in the firs embodiment where the rotation center is set about the axis Ay parallel to the y-direction. Further, when an adjustor mechanism is added to adjust the foot position on each of the left and right foot supports 2*a* and 2*b* with respect to the y-direction of the support coordinate system, it is made to vary the shift amount of the user's weight center and/or the amount of the load acting on the foot with respect to the lateral direction depending the foot position.

In the illustrated embodiment, the tilt angle is caused to vary with the movement of the corresponding one of the left and right foot supports 2*a* and 2*b* within the X-Y plane of the frame coordinate system. However, it may be possible to adjust the tilt angle to a constant value depending upon the degree of the bow legs or knock-knees, and to maintain thus adjusted tilt angle irrespective of the varying positions of the left and right foot supports 2*a* and 2*b*. The other configurations and operations are identical to those of the first embodiment.

Sixth Embodiment

Figure 26:
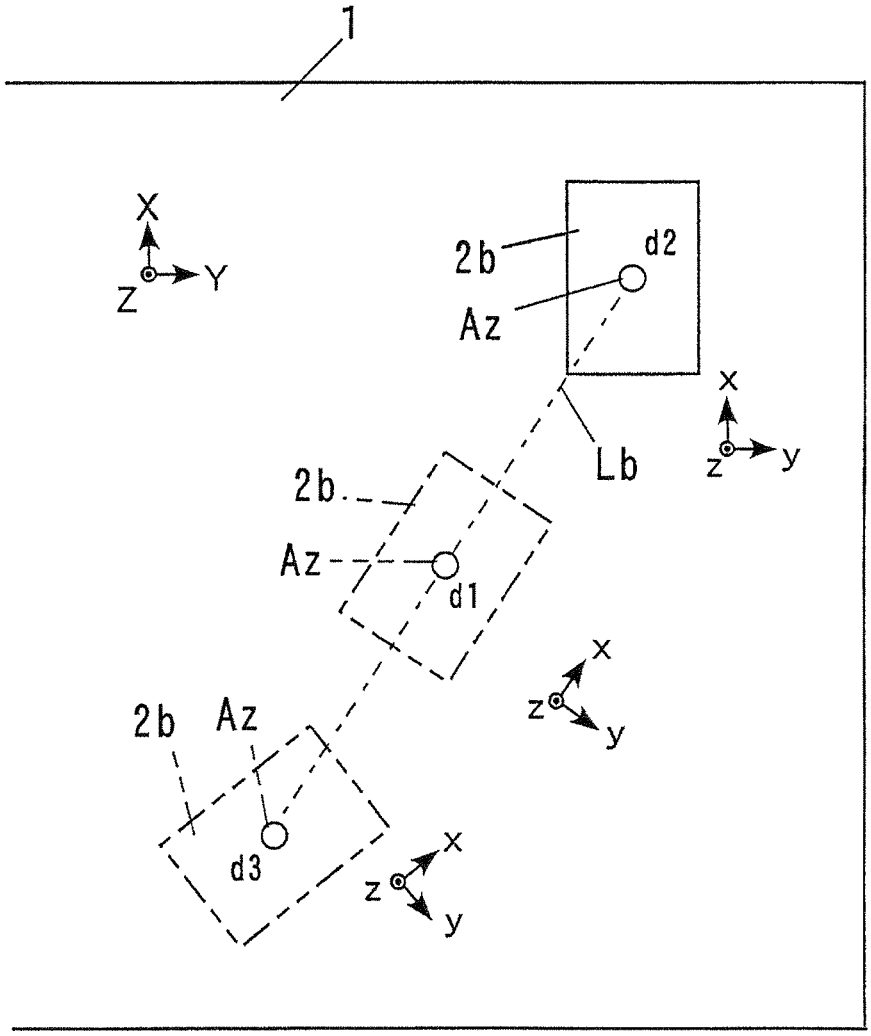
FIG. 26 is an explanatory view showing an operation of a passive exercise assisting device in accordance with a sixth embodiment of the present invention.

FIG. 26 illustrates the embodiment in which each of the left and right foot supports 2*a* and 2*b* is allowed to swing about the axis Ax parallel to the z-direction of the support coordinate system, in contrast to the first embodiment in which the foot support is allowed to swing about the axis Ay parallel to the y-direction. Contrary to the previous embodiments where each of the left and right foot supports 2*a* and 2*b* is held stationary about the axis Az parallel to the z-direction such that the frame coordinate system and the support coordinate system share the same directional axes, the present embodiment necessitates the foot support to swing about the axis Az so that the support coordinate system has its x-direction and the y-direction respectively differing from the X-direction and Y-direction of the frame coordinate system.

Also in the present embodiment in which each of the left and right foot supports 2*a* and 2*b* is configured to swing about the axis Az parallel to the z-direction, there are two modes, one for varying the tilting angle as each of the left and right foot supports 2*a* and 2*b* moves within the X-Y plane of the frame coordinate system, and the other for fixing the tilt angle free from varying depending upon the positional change in the X-Y plane, as in the previous embodiment where the foot support is configured to swing about the Ay parallel to the x-direction or y-direction.

The illustrated embodiment is for varying the tilt angle in such a manner to give a maximum angle between the X-direction of the frame coordinate system and the x-direction of the support coordinate system when each of the left and right foot supports 2*a* and 2*b* comes to its rearward end position within each of the travel paths La and Lb, and a minimum angle when it comes to is forward end position.

As each of the left and right foot supports 2*a* and 2*b* is caused to vary its tilt angle about the Az parallel to the z-direction of the support coordinate system in accordance with the movement of the representative point of each foot support within the X-Y plane of the frame coordinate system, the hip joint on the side of the corresponding one of the legs to thereby stretch the muscle groups around the hip joint, and therefore enhance the flexibility of the hip joint. In addition, the user sees a large body trunk twisting to have an increased visceral stimulation than expected in the absence of the swinging about the axis Az parallel to the z-direction.

Although the illustrated embodiment is given to swing each of the left and right foot supports 2*a* and 2*b* about the axis Az parallel to the z-direction in the support coordinate system in accordance with the positional change within the X-Y plane of the frame coordinate system, the device may be added with an adjustor mechanism for adjusting the tilt angle to a fixed value at the position where no shearing force acts on the knee joint, and be configured to keep the adjusted tilt angle irrespective of the varying position of the foot support within the X-Y plane in order that the user suffering from the knee pain can be easy to use the device without an extra knee pain.

In contrast to the illustrated embodiment where each of the left and right foot supports 2*a* and 2*b* moves linearly to trace the same travel path when moving forward and rearward, it is possible to move the foot supports respectively not along linear travel paths but along suitably curved travel paths La and Lb. Such curved travel path may be conic (circular, elliptic, parabolic, hyperbolic), or any other curve or polygonal line. Further, the foot support is configured to trace different travel paths when moving forward and rearward. For instance, each of the paths La and Lb may be elliptic. In any case, the travel paths La and Lb is made to be spaced laterally by a distance which is different at the forward ends of the paths from at the rearward ends thereof such that a left line passing through the forward end and the rearward end of the left travel path crosses with a right line passing through the forward end and the rearward end of the right travel path to form a V-shape or inverted V-shape.

Figure 27:
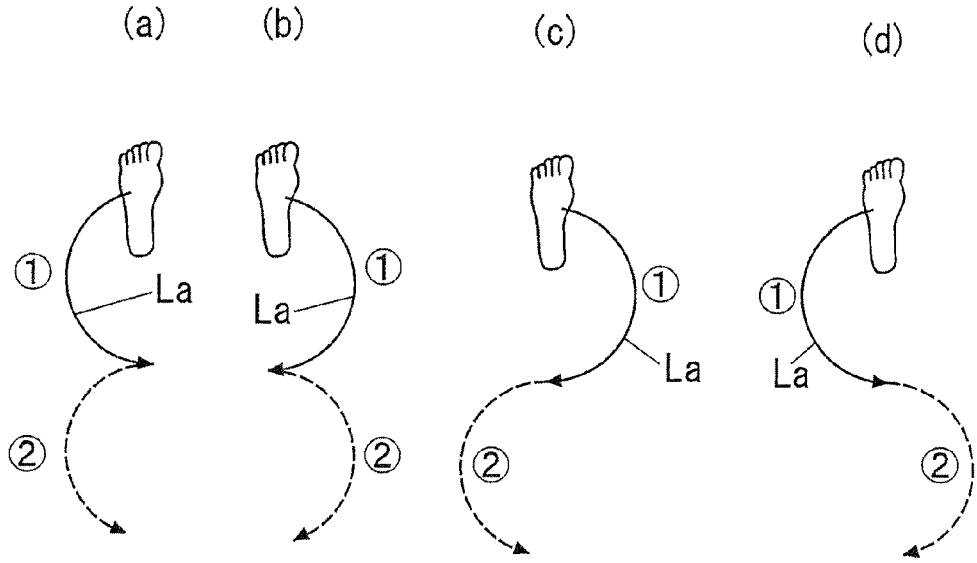
FIGS. 27(*a*) to 27(*d*) illustrate another operation of the above device.

Patterns of the travel path La will be now explained. The travel path La is labeled with circled numerals designating the order of the movement. For instance, FIG. 27 shows four patterns of the travel path La each being a combination of an arc of the circle or ellipse. FIG. 27(*a*) shows the travel path La composed of two successive semicircular arcs each bowed outwardly. FIG. 27(*b*) shows the travel path La composed of two successive semicircular arcs each bowed inwardly as opposed to that of FIG. 27(*a*). FIG. 27(*c*) shows the travel path La composed of two successive semicircular arcs with the forwardly located one being bowed inwardly, the rearward one bowed outwardly. FIG. 27(*d*) shows the travel path La composed of two successive semicircular arcs with the forwardly located one being bowed outwardly, the rearward one bowed inwardly, in the opposite relation to those of FIG. 27(*c*). Although the illustrated patterns is composed of two successive semicircular arcs, semi-elliptic arcs may be relied upon.

Further, the foot support may be configured to trace different travel paths La when moving rearward than when moving forward. For instance, the foot support may trance one the travel paths of FIG. 27 in its rearward movement and trace a linear travel path in its forward movement.

Figure 28:
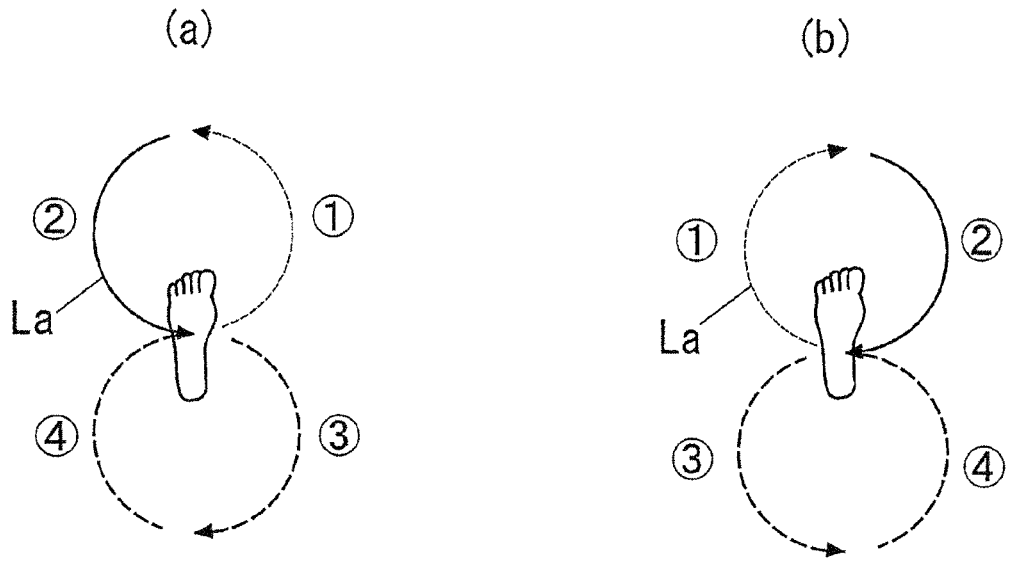
FIGS. 28(*a*) and 28(*b*) illustrate a further operation of the above device.

FIG. 28 illustrates two figure-eight shaped patterns of the travel path. FIG. 28(*a*) illustrates that the foot supports traces, when moving rearward, a portion of the path La composed of two successive semicircular arcs one being bowed outwardly and the other bowed inwardly, and traces, when moving forward, a portion of the path La composed of two successive semicircular arcs one being bowed outwardly and the other bowed inwardly. That is, the foot support moves along the travel path La of FIG. 27(*d*) when moving from the forward end position to the rearward end position, and the foot support moves reversely along the travel path La of FIG. 27(*c*) when moving from the rearward end position to the forward end position.

FIG. 28(*a*) illustrates the pattern reverse to that of FIG. 28(*a*), where the foot support moves along the travel path La of FIG. 27(*c*) when moving from the forward end position to the rearward end position, and the foot support moves reversely along the travel path La of FIG. 27(*d*) when moving from the rearward end position to the forward end position.

Figure 29:
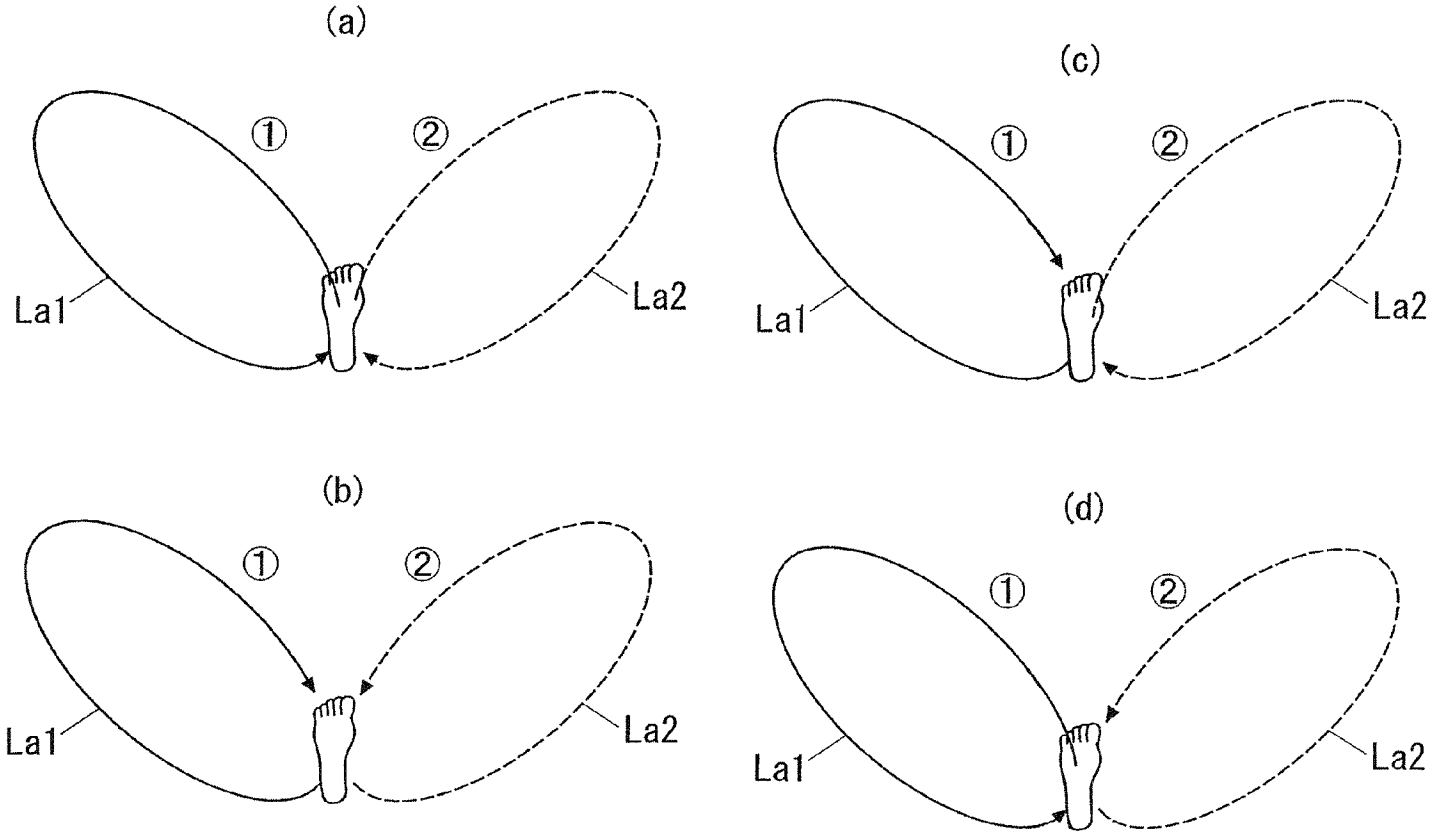
FIGS. 29(*a*) to 29(*d*) illustrate a still further operation of the above device.

FIG. 29 illustrates four patterns of the figure-∞ shaped trace path La each composed of two successive elliptic curves, one defining an outward path La1 extending laterally outwardly, and the other defining an inward path La2 extending laterally inwardly. The outward path La1 means a path along which the foot support traces when moving laterally outwardly from the rearward end position to the forward end position and back to the rearward end position, while the inward path La2 means a path along which the foot support traces when moving laterally inwardly from the rearward end position to the forward end position and back to the rearward end position. In each of the paths La1 and La2, the foot support moves along different routes when moving forward than moving rearward. Hereinafter, when the foot support moves forwardly along the route or the portion of the path located inside of the other potion along which it moves rearward, the foot supports is called to undergo an inward turning, while the foot support moves forwardly along the route or the portion of the path located outwardly of the other portion of path along which it moves rearward, the foot support is called to undergo an outward turning.

FIG. 29(*a*) illustrates the travel path La in which the foot support undergoes the inward turning along each of the paths La1 and La2, while FIG. 29(*b*) illustrates the travel path La in which the foot support undergoes the outward turning along each of the paths La1 and La2. FIG. 29(*c*) illustrates that the foot support undergoes the outward turning along the outward path La1, and undergoes the inward turning along the inward path La2, while FIG. 29(*d*) illustrates that the foot support undergoes the inward turning along the outward path La1 and then undergoes the outward turning along the inward path La2.

The travel path La may be configured differently from the above illustrated patterns. Although some of above trace paths are difficult to be realized simply by the shaping of the rails 17, they can be realized by using a combination of mechanical elements such as suitably shaped cams and/or clutches.

Although the illustrated embodiment explains that the left and right foot supports 2*a* and 2*b* are driven to move in the opposite phase relation or in the other relation than the opposite phase relation, it is also possible to move one of the left and right foot supports 2*a* and 2*b* while keeping the other stationary or even to alternately move one of the foot supports while stopping the other. Further, in contrast to the previous embodiments, the left and right foot supports 2*a* and 2*b* are configured to move individual trace paths La and Lb which are different from each other, or the left and right foot supports 2*a* and 2*b* are configured to move alternately along the different paths.

In the above mentioned embodiments, the foot support is configured to vary its tilt angle of the foot support about either of the axis Ax parallel to the x-direction, axis Ay parallel to the y-direction, or the axis Ax parallel to the z-direction. Either of such configurations may be applied in combination with the forward/rearward movement (along X-direction) and/or lateral movement (along Y-direction) of each of the left and right foot supports 2*a* and 2*b*. Further, either of the above configurations may be alone relied upon for the structure in which the left and right supports 2*a* and 2*b* are held stationary relative to the housing 1. This is, the swinging movement of the foot support about either of the axis Ax, Ay, or Az can be applied to the structure in which the left and right foot supports 2*a* and 2*b* trace the travel paths arranged in other than the V-shaped or inverted V-shaped pattern. Further, separate controls may be made respectively to move the representative points of the left and right foot supports 2*a* and 2*b*, and to swing the same about the axis Ax, Ay, or Az.

Figure 30:
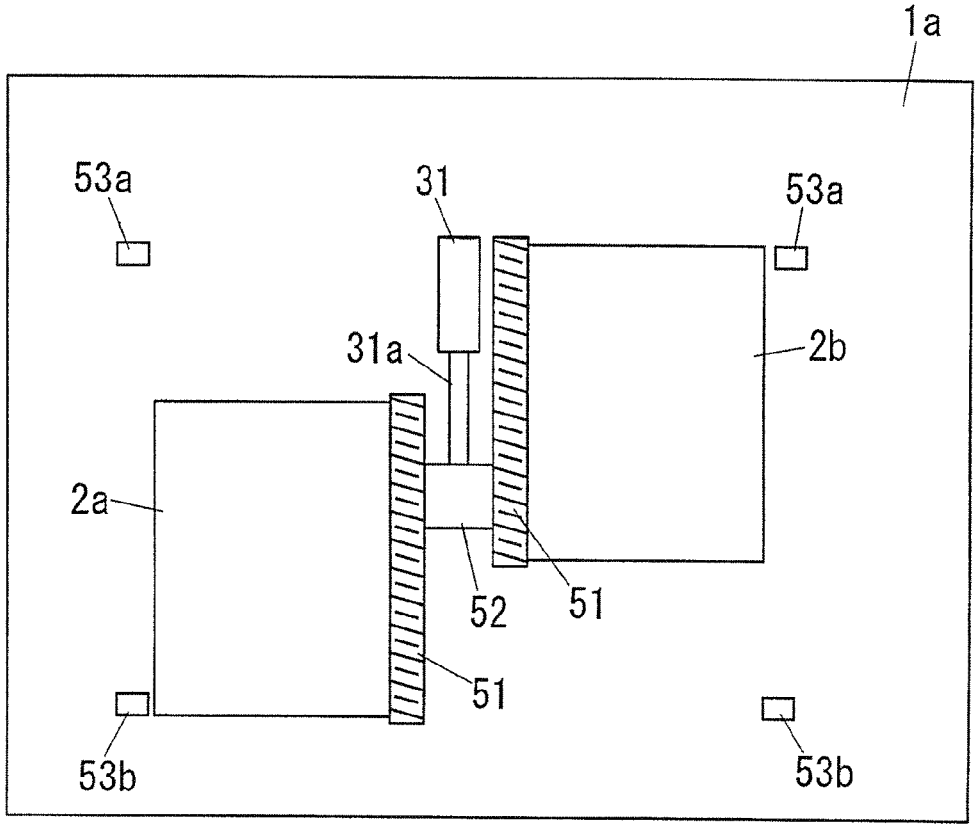
FIG. 30 is a schematic view showing the above device of another configuration.

In this instance, a driving mechanism for moving each of the left and right foot supports 2*a* and 2*b* may be configured to include, as shown in FIG. 30, a screw rod 51 coupled to each of the left and right foot supports 2*a* and 2*b*, and a small gear (e.g., worm) 52 which engages with the screw rod 51 and is driven to rotate by the motor 31.

In order to change the movement direction of the left and right foot supports 2*a* and 2*b*, the motor 31 is required to switch the rotating direction. For this purpose, position sensors 53*a* and 53*b* are provided to detect the individual positions of the left and right foot supports 2*a* and 2*b* (two sensors are disposed for each of the left and right supports 2*a* and 2*b* for detection of the forward and rearward end positions) so as to change the rotating direction of the motor 31 (controller for controlling the motor based upon the outputs from the position sensors 53*a* and 53*b* are not shown). Each of the position sensors 53*a* and 53*b* may be a proximity sensor or photoelectric sensor.

When establishing the in phase or opposite phase relation between the movements of the left and right foot supports 2*a* and 2*b* with the use of a single motor 31 that drives both of the left and right foot supports 2*a* and 2*b*, one of the foot supports comes to its forward end position when the other comes to its forward end position (in phase relation) or rearward end position (opposite phase relation). Accordingly, the position sensors may be provided only with regard to one of the left and right foot supports 2*a* and 2*b*. Instead of the position sensor, it is possible to use a rotary encoder for detection of rotational speed, or a circuit of monitoring a load current through the motor 31 for detection of the rotational speed.

When the rail 17 is employed to move the representative position of each of the left and right foot supports 2*a* and 2*b* in the forward/rearward direction or in the lateral direction, it is suffice to set the orientation of the rail. When the screw rod 51 is employed for the same purpose, it is suffice to set the orientation of the screw rod 51. In addition, it is possible to select a suitable phase relation between the movements of the left and right supports 2*a* and 2*b* by adjusting the position of engaging the screw rod 51 with the worm 52.

Seventh Embodiment

The following embodiment explains a mechanism of swinging the foot support about the axis Ax or Ay. Unless otherwise deemed necessary, no explanation is made to the movement of the left and right foot supports 2*a* and 2*b*.

In contrast to the above embodiments where the tilt angle about the axis Ax or Ay is defined symmetrically with respect to a 0° center (horizontal) plane, the center plane may be offset relative to the horizontal. For instance, when the center plane is offset by 10° about the axis Ay (i.e., offset toward dorsiflexion-inducing side) to have a maximum tilt angle of 30° at the dorsiflexion and have a maximum angle of −10° at the plantarflexion, it is expected to increase an effect of stretching the Achilles tendon. A term "offset angle" is referred to as defining an angle of the central plane relative to the horizontal.

Figure 18:
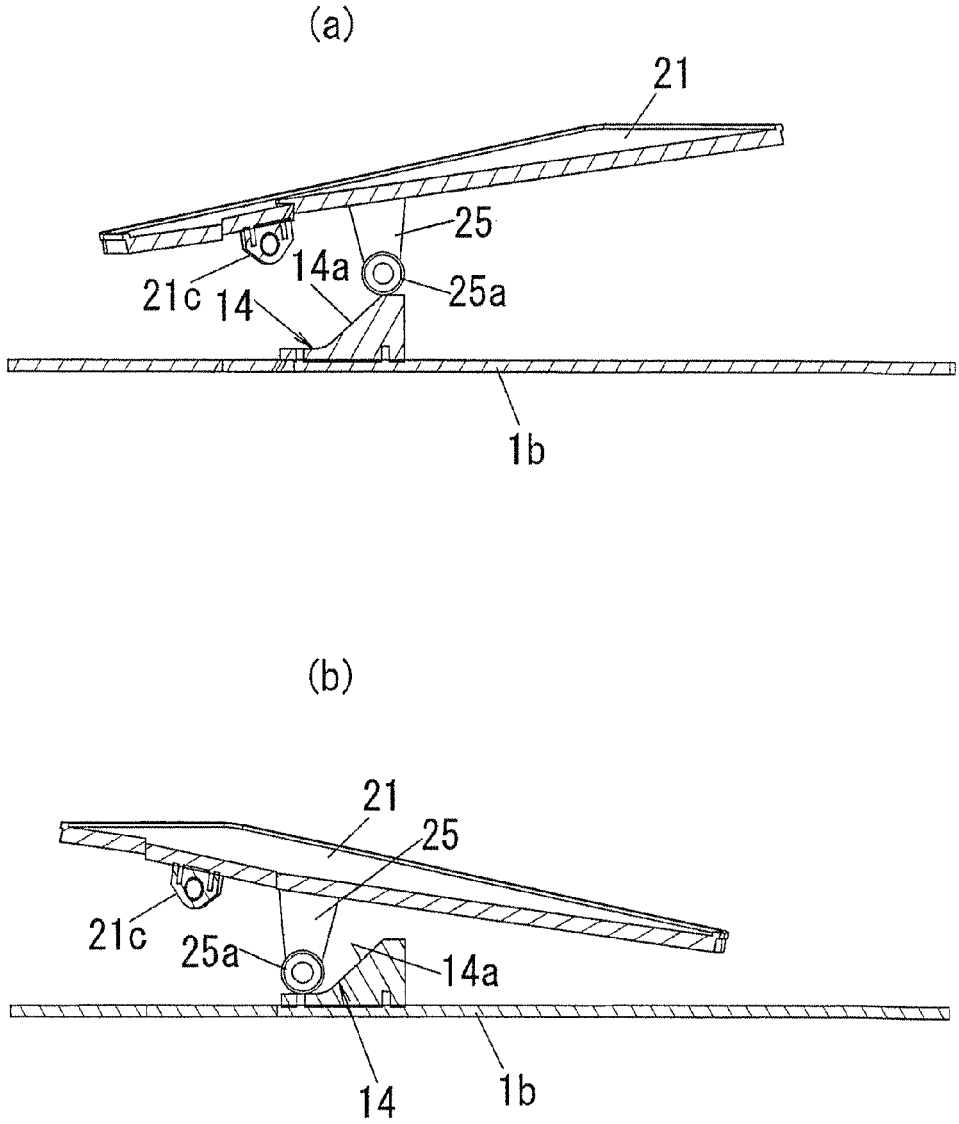
FIGS. 18(*a*) and 18(*b*) are explanatory views of the above device.

In order to offset the center plane, a modification is made to the profile of the guide surface 14 or to the positional relation between the bearing 21*c* and the follower projection 25 for the structure shown in the first embodiment of FIG. 18. When using the structure of the third embodiment of FIG. 21, a modification is made to the coupling point of the crank rod 46 of the second driver 33*b* with the eccentric rotor 45, or to a meshing relation between the spur gears 42 and 43. When using the structure of the fourth embodiment of FIG. 23, a modification is made to the profile of the cam groove 28 in each of the side plate 27, or to a positional relation between the cam grooves 28 and the guide bars 29.

The adjustment of the offset angle is available for each of the above embodiments. In the structure of using the cam grooves 28 and the guide bars 29, the offset angle can be adjusted simply by changing the positions of the guide bars 29, which enables the user to easily adjust the offset angle. Besides, the offset can be given also by controlling a timing of switching the rotating direction with the use of a reversible motor 31. In this instance, the movable range of the left and right foot supports 2*a* and 2*b* varies accordingly. As discussed in the above, the offset is given also in the case where each of the left and right foot supports 2*a* and 2*b* is driven to move with its upper surface inclined relative to the horizontally at a constant tilt angle.

The housing 1 may be inclined or at least one of the left and right foot supports 2*a* and 2*b* is inclined in order to give the offset relation. When the housing 1 is inclined, the offset may be given in a direction of adjusting the tilt angle of each of the foot supports 2*a* and 2*b* about the axis along the X-direction or the Y-direction of the frame coordinate system rather than the axis Ay parallel to the y-direction of the support coordinate system, because of the difficulty in providing the offset separately to each of the left and right foot supports 2*a* and 2*b*. When inclined about the axis along the X-direction, the user's body trunk is expected to tilt left or right, thereby generating unbalanced load acting differently on the left leg and right leg and therefore enable to intensively strengthen the muscle groups of one of the legs.

In order to incline the housing 1, the housing 1 may be added at its rear end with a lifting mechanism such as a jack to vary the height of its rear end by use of the rotation force of the motor. The lifting mechanism may include a lazy tong, pantograph, and/or a screw rod that is driven by the motor. Alternatively, the housing 1 is provided with a plurality of stands (screw-in stands) for supporting the housing 1 on the floor so as to be inclined to a suitable angle by adjusting the screw-in amount or the length of each stand.

When giving the offset to the left and right foot supports 2*a* and 2*b*, the lifting mechanism may use the jack, air-bags inflatable by a pressurized air, or magnetic repulsion force of magnets to adjust the height position of the intended portions of the foot. Further, each of the left and right foot supports 2*a* and 2*b* may be configured to have the tow follower projections 25 which come into contact respectively with differently shaped guide surfaces 14 in order to give the offset to each foot support about the axis Ax parallel to the x-direction. Still further, the offset may be given by use of a accessory plate detachable to at least one of the left and right foot supports 2*a* and 2*b*. That is, the auxiliary plate has its upper surface inclined relative to its lower surface at a suitable angle which defines the offset angle.

Figure 31:
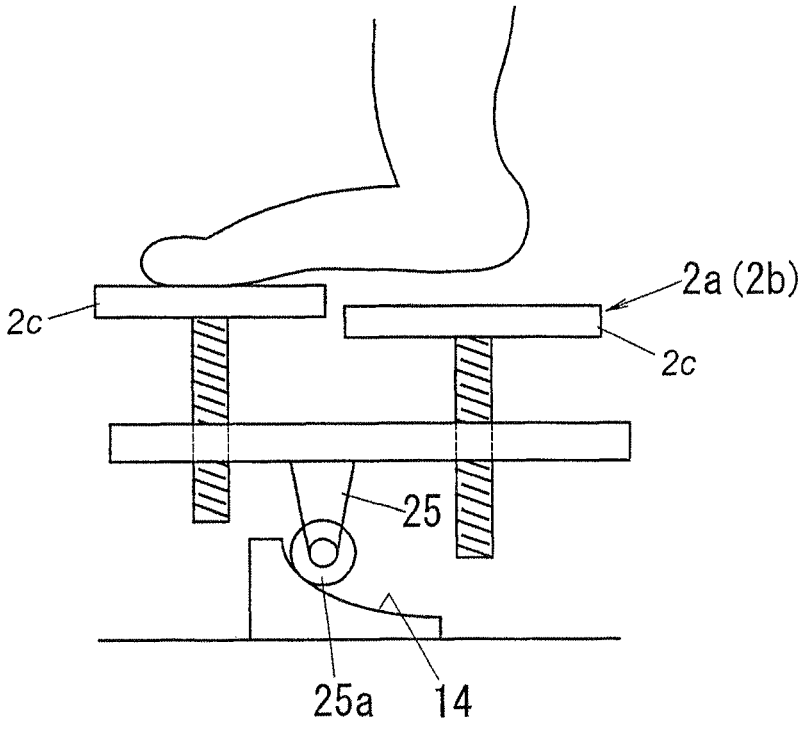
FIG. 31 is a side view showing a principal part of a passive exercise assisting device in accordance with a seventh embodiment of the present invention.

As shown in FIG. 31, in order to achieve the same effect as expected by the offset, at least one of the left and right foot supports 2*a* and 2*b* may be divided into separate supports 2*c* each of which is adjustable in its height to receive different load from the foot bottom. When the separate supports 2*c* are arranged in the length of the foot with the rear one being positioned slightly lower than the front one, substantially the same dorsiflextion effect is given as the offset causes the dorsiflexion.

Figure 32:
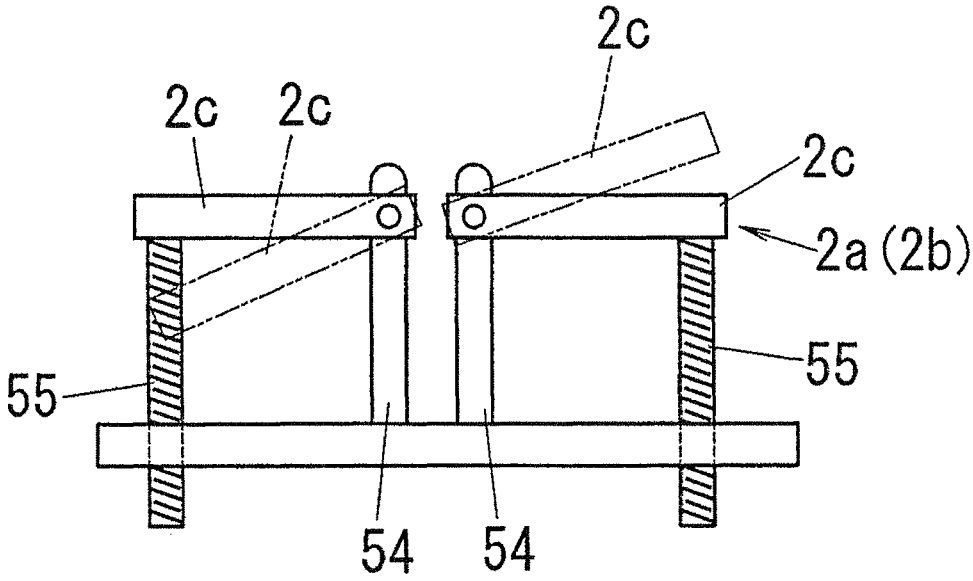
FIG. 32 is a side view showing a principal part of the above device of another configuration.

Alternatively, as shown in FIG. 32, each separate supports 2*c* may be pivoted at its one of the front and rear ends to a prop 54, with the other end being driven by the lifting mechanism to adjust its height. The lifting mechanism may include the lazy tong, pantograph, and/or the screw rod (screw rod 55 is shown in the illustrated embodiment). For example, the he lifting mechanism is driven by the motor (to rotate the worm (not shown) in mesh with the screw rod 55 for moving the screw rod 55 vertically).

In this connection, different offset angles are given respectively to the left and right foot supports 2*a* and 2*b* when both of the supports are required to have the offset. Accordingly, the user suffering from disease at one of the left right legs can enjoy the exercise at the other leg.

Figure 33:
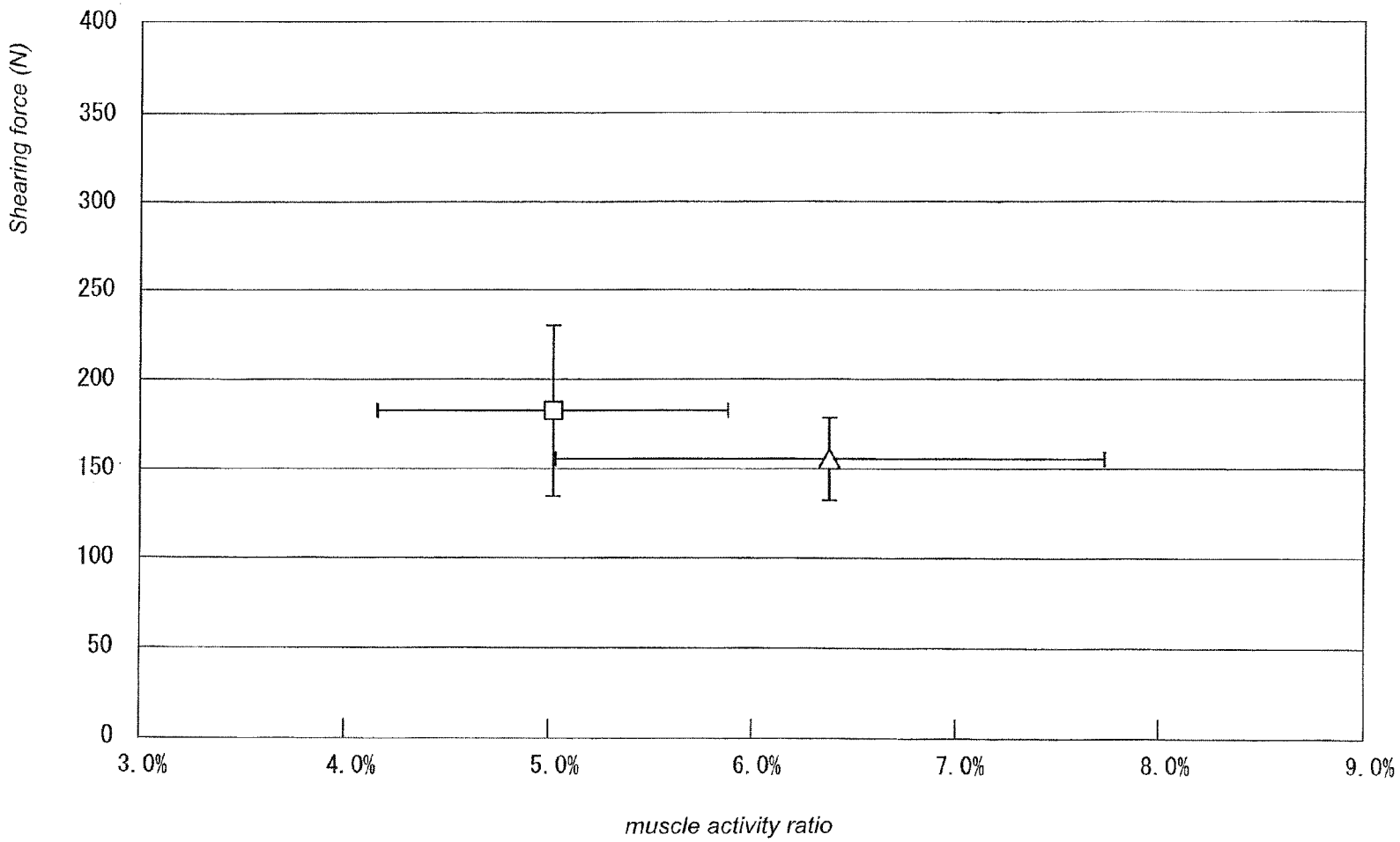
FIG. 33 illustrates an effect of the above device.

FIG. 33 illustrates the muscle activity ratio in relation to the shearing force acting on the knee joint respectively in a situation (A) where the dorsiflexion is intended by an offset angle of 2.5° and a situation (B) where no offset is made, for demonstrating a comparison result. In each situation, the foot support is allowed to swing about the axis Ay extending along the y-direction in correspondence to the ankle joint, and is caused to tile the ankle respectively at tilt angles of 2°, 6°, and 10°, while the left and right foot supports 2*a* and 2*b* are driven to reciprocate at a frequency of 1.6 Hz respectively along paths inclined at angles of 45° and −45° (i.e., along the V-shaped motion pattern and the inverted V-shaped motion pattern), and at an amplitude of 20 mm for each of the reciprocation paths. From this result, no substantial difference is seen in the shearing force acting on the knee joint, but the muscle activity ratio is higher when providing the offset than not.

The operation explained in the above embodiments can be suitably combined. The housing 1 may have its top surface rounded rather than flat. That is, the left and right foot supports 2*a* and 2*b* may be configured to move along the curved top surface of the housing 1. Further, the guide surface 14 may be configured to vary the tilt angle in such a nonlinear relation that the each of the left and right foot supports 2*a* and 2*b* repeats to climb up and down more than one time while the foot support moves in one direction between its forward and rearward end positions, thereby repeating the cycles of the dorsiflexion and the plantarflexion for enhanced stimulation to the lower leg muscle groups.

Although the above embodiments employ the single motor 1 for making the sliding movement of the left and right foot supports 2*a* and 2*b* and simultaneously tilting the same, the two motors may provided to respectively move the left and right foot supports while dispensing with the router 32. Further, in addition to separately moving the left and right foot supports 2*a* and 2*b*, the first drive 33*a* and the second drive 33*b* may be driven separately by the individual motors. In such instance, a control circuit is necessary for associating the motors with the intended operations. The motor may be a rotary motor or linear motor.

The invention claimed is:

1. A passive exercise assisting device comprising:

a left foot support and a right foot support respectively configured to bear a user's left foot and right foot;

a drive unit configured to move said left and right supports in a mutually linked manner; and a carrier mounting said left foot support, said right foot support, and said drive unit, wherein said drive unit being configured to reciprocate said left and right foot supports in a forward/rearward direction respectively along individual travel paths, while varying a lateral distance between said left and right foot supports with regard to representative points of the left and right foot supports, and wherein said lateral distance between forward ends of said travel paths differs the lateral distance between rearward ends of said travel paths, and said representative point of said left foot support is selected to a point which does not fluctuate with varying an inclination angle of said tell foot support relative to said carrier, and said representative point of said right foot support is selected to a point which does not fluctuate with varying an inclination angle of said right foot support relative to said carrier.

2. A passive exercise assisting device as set forth in claim 1, wherein said drive unit is configured to move the left and right foot supports respectively along said individual travel paths which are laterally spaced by a distance which is greater at their forward ends than at the rearward ends.

3. A passive exercise assisting device as set brat in claim 1, wherein said drive unit is configured to move the left and right foot supports respectively along said individual travel paths which are laterally spaced by a distance which is smaller at their forward ends than at the rearward ends.

4. A passive exercise assisting device as set forth in any one of claims 1 to 3, wherein said drive unit is configured to move said left and right foot supports respectively along the individual travel paths in an opposite phase relation to each other in order to keep a center of gravity of the user at a constant position in the forward/rearward direction.

5. A passive exercise assisting device as set forth in any one of claims 1 to 3, wherein said drive unit is configured to shift the left and right foot supports within a common plane.

6. A passive exercise assisting device as set forth in any one of claims 1 to 3, wherein said drive unit is configured to move the left and right foot supports respectively along the individual travel paths each extending linearly.

7. A passive exercise assisting device as set forth in any one of claims 1 to 3, wherein said drive unit is configured to pivot each of said left and right foot supports about its width axis extending in parallel to a width of the user's foot.

8. A passive exercise assisting device as set forth in any one of claims 1 to 3, wherein said drive unit is configured to pivot each of said left and right foot supports about its upright axis perpendicular to a top surface of the corresponding one of said left and right foot supports.

9. A passive exercise assisting device as set forth in any one of claims 1 to 3, wherein said drive unit is configured to pivot each of said left and right foot supports about its lengthwise axis parallel to the length of the user's foot.

10. A passive exercise assisting device comprising:

a left foot support and a right foot support respectively configured to bear a user's left foot and right foot;

a drive unit configured to move said left and right foot supports in a mutually linked manner; and a carrier mounting said left foot support, said right foot support, and said drive unit, wherein said drive unit is configured to reciprocate said left and right foot supports to move a representative point of each supports in a forward/rearward direction, while allowing each of said left and right foot supports to pivot about its width axis extending in a width direction of the user's foot, and said representative point of said left foot support is selected to a point which does not fluctuate with varying an inclination angle of said left foot support relative to said carrier, and said representative point of said right foot support is selected to a point which does not fluctuate with varying an inclination angle of said right foot support relative to said carrier.

11. A passive exercise assisting device comprising:

a left foot support and a right foot support respectively configured to bear a user's left foot and right foot;

a drive unit configured to move said left and right foot supports in a mutually linked manner; and a carrier mounting said left foot support, said right foot support, and said drive unit, wherein said drive unit is configured to reciprocate said left and right foot supports to move a representative point of each supports in a forward/rearward direction, while allowing each of said left and right foot supports to pivot about its upright axis perpendicular to a top surface of the corresponding one of said left and right foot supports, and said representative point of said left foot support is selected to a point which does not fluctuate with varying an inclination angle of said left foot support relative to said carrier, and said representative point of said right foot support is selected to a point which does not fluctuate with varying an inclination angle of said right foot support relative to said carrier.

12. A passive exercise assisting device comprising:

a left foot support and a right foot support respectively configured to bear a user's left foot and right foot;

a drive unit configured to move said left and right foot supports in a mutually linked manner; and a carrier mounting said left foot support, said right loot support, and said drive unit, wherein said drive unit is configured to reciprocate said left and right foot supports to move a representative point of each supports in a forward/rearward direction, while allowing each of said left and right foot supports to pivot about its lengthwise axis extending parallel to the length of the user's foot, and said representative point of said left foot support is selected to a point which does not fluctuate with varying an inclination angle of said left foot support relative to said carrier, and said representative point of said right foot support is selected, to a point which does not fluctuate with varying an inclination angle of said right foot support relative to said carrier.

13. A passive exercise assisting device comprising:

a left foot support and a right foot support respectively configured to bear a user's left foot and right foot;

a drive unit configured to move said left and right foot supports in a mutually linked manner; and a carrier mounting said left foot support, said right foot support, and said drive unit, wherein said drive unit is configured to reciprocate said left and right foot supports in such a manner as to vary a lateral distance between said left and right foot plates with regard to representative points of the left and right foot supports, while allowing each of said left and right foot supports to pivot about its width axis extending parallel to a width direction of the user's foot, and said representative point of said left foot support is selected to a point which does not fluctuate with varying an inclination angle of said left foot support relative to said carrier, and said representative point of said right foot support is selected to a point which does not fluctuate with varying an inclination angle of said right foot support relative to said carrier.

14. A passive exercise assisting device comprising:

a left foot support and a right foot support respectively configured to bear a user's left foot and right foot;

a drive unit configured to move said left and right foot supports in a mutually linked manner; and a carrier mounting said left foot support, said right foot support, and said drive unit, wherein said drive unit is configured to reciprocate said left and right foot supports in such a manner as to vary a lateral distance between said left and right foot supports with regard to representative points of the left and right foot supports, while allowing each of said left and right foot supports to pivot about its upright axis perpendicular to a top surface of the corresponding one of said left and right foot supports, and said representative point of said left foot support is selected to a point which does not fluctuate with varying an inclination angle of said left foot support relative to said carrier, and said representative point of said right foot support is selected to a point which does not fluctuate with varying an inclination angle of said right foot support relative to said carrier.

15. A passive exercise assisting device comprising:

a left foot support and a right foot support configured to bear a user's left foot and right foot respectively;

a drive unit configured to move said left and right foot supports in a mutually linked manner; and a carrier mounting said left foot support, said right foot support, and said drive unit, wherein said drive unit is configured to reciprocate said left and right foot supports in such a manner as to vary a lateral distance between said left and right foot plates with regard to representative points of the left and right foot supports, while allowing, each of said left and right foot supports to pivot about its lengthwise axis extending in parallel with the length of the corresponding one of the left and right foot supports, and said representative point of said left foot support is selected to as point which does not fluctuate with varying an inclination angle of said left foot support relative to said carrier, and said representative point of said right foot support is selected to a point which does not fluctuate with varying an inclination angle of said right loot support relative to said carrier.

16. A passive exercise assisting device as set forth in any one of claims 1-3 and 10-15, wherein at least one of said left and right foot supports is configured to vary its surface angle relative to as horizontal plane within a predetermined range while it is driven to move by said drive unit.

17. A passive exercise assisting device as set forth in any one of claims 1-3 and 10-15, further including:

said carrier having a top surface inclined at a predetermined angle relative to a horizontal plane.

18. A passive exercise assisting device comprising:

a left foot support and a right foot support respectively configured to bear a user's left foot and right foot;

a drive unit configured to move said left and right foot supports in a mutually linked manner; and a carrier mounting said left foot support, said right foot support, and said drive unit, wherein said drive unit is configured to reciprocate said left and right foot supports to move a representative point of each of said left and right foot supports in a forward/rearward direction, and wherein at least one of said left and right foot supports is configured to vary its surface angle relative to a horizontal plane within a predetermined range while it is driven to move by said drive unit, and said representative point of said left loot support is selected to a point which does not fluctuate with varying an inclination angle of said left foot support relative to said carrier, and said representative point of said right foot support is selected to a point which does not fluctuate with varying an inclination angle of said right foot support relative to said carrier.

19. A passive exercise assisting device comprising:

a left foot support and a right foot support respectively configured to hear a user's left foot and right foot;

a drive unit configured to move said left and right foot supports in a mutually linked manner; and a carrier mounting said left foot support, said right foot support and said drive unit, wherein said drive unit being configured to reciprocate said left and right foot supports to move a representative point of each of said left and right foot supports in a forward/rearward direction, and wherein said carrier has a top surface inclined at a predetermined angle relative to a horizontal plane, and said representative point of said left foot support is selected to a point which does not fluctuate with varying an inclination angle of said left foot support relative to said carrier, and said representative point of said right foot support is selected to a point which does not fluctuate with varying an inclination angle of said right foot support relative to said carrier.

20. A passive exercise assisting device comprising:

a left foot support and a right foot support respectively configured to bear a user's left foot and right foot;

a drive unit configured to move said tell and right foot supports in a mutually linked manner; and a carrier mounting said left foot support, said right foot support, and said drive unit, wherein said drive unit is configured to reciprocate said left and right foot supports in such a manner as to vary a lateral distance between said left and right foot plates with regard to representative points of the left and right foot supports, and wherein at least one of said left and right foot supports is configured to vary its surface angle relative to a horizontal plane within a predetermined range while it is driven to move by said drive unit, and said representative point of said left toot support is selected to a point which does not fluctuate with varying an inclination angle of said left foot support relative to said carrier, and said representative point of said right foot support is selected to a point which does not fluctuate with varying an inclination angle of said right foot support relative to said carrier.

21. A passive exercise assisting device comprising:

a left loot support and a right foot support respectively configured to bear a user's left foot and right foot;

a drive unit configured to move said left and right foot supports in a mutually linked manner, and a carrier configured to mount said left foot support, said right foot support, and said drive unit, wherein said drive unit is configured to reciprocate said left and right foot supports in such a manner as to vary a lateral distance between said left and right foot plates with regard to representative points of the left and right foot supports, and said carrier has a top surface inclined at a predetermined angle relative to a horizontal plane, and said representative point of said left foot support is selected to a point which does not fluctuate with varying an inclination angle of said left foot support relative to said carrier, and said representative point of said right foot support is selected to a point which does not fluctuate with varying an inclination angle of said right foot support relative to said carrier.

22. A passive exercise assisting device as set forth in claim 1, wherein said drive unit is configured to move said left and right foot supports respectively along the individual travel paths each extending linearly, said left and right foot supports having lengthwise directions with which a user aligns longitudinal center lines of one's feet, respectively, and moving directions of said left and right foot supports being different from the lengthwise directions of said left and right foot supports, respectively.

23. A passive exercise assisting device as set forth in claim 22, wherein said left and right foot supports have their individual lengthwise directions angled relative to the forward/rearward direction, such that the user in the standing posture can place the feet respectively on said left and right loot supports with one's leg muscles kept relaxed.

24. A passive exercise assisting device as set forth in claim 23, wherein the individual moving directions of said left and right foot supports are inclined in relation to the forward/rearward direction at a large angle than the individual lengthwise directions of said left and right foot supports.

25. A passive exercise assisting device as set forth in claim 24, wherein said left and right foot supports have their individual lengthwise directions angled at 5' to 15° relative to the forward/rearward direction.

26. A passive exercise assisting device as set forth in claim 25, wherein said left and right foot supports have their individual moving directions angled at 45° to 75° relative to the forward/rearward direction.

* * * * *